US009688458B1

(12) United States Patent
Hamilton

(10) Patent No.: US 9,688,458 B1
(45) Date of Patent: Jun. 27, 2017

(54) FOLDING PORTABLE CRAFT GUN WITH STORAGE FOR PLUNGER ROD

(71) Applicant: Hasbro, Inc., Pawtucket, RI (US)

(72) Inventor: Thomas P Hamilton, Cranston, RI (US)

(73) Assignee: Hasbro, Inc., Pawtucket, RI (US)

( * ) Notice: Subject to any disclaimer, the term of this patent is extended or adjusted under 35 U.S.C. 154(b) by 346 days.

(21) Appl. No.: 14/283,013

(22) Filed: May 20, 2014

Related U.S. Application Data

(60) Provisional application No. 61/829,410, filed on May 31, 2013.

(51) Int. Cl.
*B65D 83/00* (2006.01)

(52) U.S. Cl.
CPC ..... *B65D 83/0033* (2013.01)

(58) Field of Classification Search
CPC ..... B65D 83/0033; B05C 17/005; B05C 17/00526
USPC ..... 222/325–327, 386
See application file for complete search history.

(56) References Cited

U.S. PATENT DOCUMENTS 945,474 A * 1/1910 Parnham ..... B05C 17/0103 15/261
1,880,354 A 10/1932 Mueller
2,074,401 A * 3/1937 Kauzal ..... A61D 7/00 604/186
3,606,085 A 9/1971 Spilman
3,819,091 A 6/1974 Hollender
4,033,346 A * 7/1977 Phillips ..... A61M 3/00 604/186
4,198,756 A * 4/1980 Dragan ..... A61C 5/062 222/326
4,295,828 A * 10/1981 Rudler ..... A61C 5/062 433/90
4,457,712 A * 7/1984 Dragan ..... A61C 5/04 222/391
4,594,073 A 6/1986 Stine
4,737,151 A 4/1988 Clement et al.
4,744,494 A * 5/1988 Seager ..... B05C 17/0123 16/225
4,968,303 A * 11/1990 Clarke ..... A61M 5/24 604/187
5,061,179 A * 10/1991 Dragan ..... A61C 5/062 433/90

(Continued)

FOREIGN PATENT DOCUMENTS

CA 2473656 A1 8/2004
EP 1256389 A2 11/2002

*Primary Examiner* — Patrick M Buechner
(74) *Attorney, Agent, or Firm* — Perry Hoffman

(57) ABSTRACT

A hand held craft gun including a housing assembly and a receptacle defined therein. A housing handle and shaft are disposed on the housing adjacent either side of the receptacle with the shaft extending away from the housing handle. A plunger handle supporting a plunger rod is disposed on the shaft and a simple yet unique coupling is employed for pivoting the plunger rod between a position unaligned with the receptacle for fun and quick filling and refilling of a modeling compound and a position aligned with the receptacle for easy extruding of the modeling compound. Additionally, at least one storage cavity at the housing handle and/or plunger handle partially contains the plunger rod in a folded position for quick and easy transport of the craft gun.

20 Claims, 15 Drawing Sheets

(56) References Cited

U.S. PATENT DOCUMENTS 5,078,690 A 1/1992 Ryan
5,125,836 A 6/1992 Dragan et al.
5,135,507 A * 8/1992 Haber ..... A61M 5/002 604/110
5,228,883 A * 7/1993 Blakely ..... A61M 5/24 222/327
5,297,980 A 3/1994 Barthold
5,395,326 A 3/1995 Haber et al.
5,408,919 A * 4/1995 Hutzler ..... A47J 37/106 222/79
5,427,528 A 6/1995 Anderson et al.
5,469,860 A 11/1995 De Santis
5,591,135 A * 1/1997 Sullivan ..... A61M 5/31551 604/207
D383,839 S * 9/1997 Sullivan ..... D24/112
5,743,436 A * 4/1998 Wilcox ..... A61C 5/064 222/137
5,799,828 A * 9/1998 Crawford ..... F41B 9/0012 222/207
6,030,368 A * 2/2000 Anwar ..... A61M 5/007 604/223
6,565,538 B2 * 5/2003 Quinn ..... A61D 1/025 604/181
6,652,494 B1 11/2003 Dragan et al.
7,118,556 B2 10/2006 Nerney
D576,273 S * 9/2008 McClintok ..... D24/113
7,534,234 B2 * 5/2009 Fojtik ..... A61B 5/153 222/386
7,976,512 B2 * 7/2011 McClintock ..... A61M 5/19 604/227
D760,382 S * 6/2016 Eisele ..... D24/113
2005/0215958 A1 9/2005 Hawthorne

* cited by examiner

FOLDING PORTABLE CRAFT GUN WITH STORAGE FOR PLUNGER ROD

BACKGROUND OF THE INVENTION

1. Field of the Invention

The present invention relates to hand held guns, applicators and syringes for craft materials, and more particularly, the invention relates to novel hand held craft applicator apparatus employing a simple yet unique coupling for pivoting a plunger rod between an unaligned position for fun and quick filling and refilling of a modeling compound and an aligned position for easy extruding of the modeling compound. The portable craft applicator apparatuses also employ simple yet unique storage cavities at a plunger handle and/or a housing handle for storing a plunger rod pivoted to a folded position and resting intermediate the plunger handle and housing handle for quick and easy transport of the folded apparatuses.

2. Background of the Invention

There are several known hand held syringes for dispensing fluids as well as some known hand held extrusion devices for extruding other flowable materials. Some of the known syringes include two handles cooperating to actuate a plunger or piston and other extruding devices employ a trigger or single handle to compress a fluid cartridge or push flowable materials through a tube. None of the known devices however, employ a simple yet unique coupling for pivoting a plunger rod between two positions, first aligning the plunger rod with a housing receptacle for traversing the rod within the receptacle and extruding a modeling compound, and second pivoting the plunger rod to an unaligned position with the receptacle for fun and quick refilling. Additionally, none of the known devices employ storage cavities at a plunger handle or housing handle for at least partially containing a plunger rod pivoted to a folded position and resting intermediate the plunger handle and housing handle for quick and easy transport of the folded device.

Known syringe devices employing two handles that cooperate to actuate a plunger or piston are exemplified and disclosed in U.S. Pat. No. 5,395,326 issued Mar. 7, 1995 to Haber et al, and U.S. Pat. No. 5,078,690 issued Jan. 7, 1992 to Ryan. Haber teaches a hand held pressure assisted syringe employing a stationary handle and a moving handle aligned to mix stored pharmaceutical and actuate the syringe. Upon initial compression of the two handle grip, a diluent discharges to a jell mix chamber and a handle actuated piston in the jell mix chamber forces discharge of the mixed pharmaceuticals. Ryan teaches a hand held high pressure syringe for injecting viscous dye into a catheter. A pistol grip shape employs two handle members guided into alignment with respect to each other for actuation of the piston and injection of the dye.

Other known syringe or extruder devices employing two handles that cooperate to actuate a plunger to aspirate or eject material into the syringe are exemplified and disclosed in U.S. Pat. No. 4,594,073 issued Jun. 10, 1986 to Stine, and U.S. Pat. No. 1,880,354 issued Jul. 30, 1931 to Mueller. Stine teaches an aspiration syringe holder with a trigger in sliding engagement with syringe to move a piston rearwardly for aspiration. A linkage attached to the trigger engages the piston of the syringe for transmitting a rearward motion of the trigger to the piston moving the piston rearwardly with respect to the syringe. Similarly, Mueller teaches two trigger members moving relative to each other but to express material from a cartridge. Mueller also teaches of employing a spring or compressing plunger, held under compression by a releasable element, to compress a cartridge and expel contained fluid when the trigger releases the releasable element. Additionally, Mueller teaches a hand lever pivotably connected at one end to a plunger and at another end to a hand grip. The hand lever actuates the plunger which is contained within a chamber and slidably engages a cartridge exerting pressure on the cartridge when the hand lever is actuated toward the hand grip. Neither the hand lever nor the hand grip includes a storage cavity for containing a non-actuating plunger and rather the plunger in Mueller remains contained within the chamber whether in an actuating or non-actuating position.

A known plunger control device employed as a retrofit attachment for an existing syringe, is exemplified and disclosed in U.S. Pat. No. 7,118,556 B2 issued Oct. 10, 2006 to Nerney. A slide is slideably mounted on the barrel of a syringe whereas movement of the slide results in a simultaneous and corresponding movement of the plunger. The slide is controlled by a user to advance or retract a plunger of the syringe.

Other known hand held extrusion devices in toys for dispensing and expelling flowable material are exemplified and disclosed in U.S. Pat. No. 5,297,980 issued Mar. 29, 1994 to Barthold, and U.S. Pat. No. 5,427,528 issued Jun. 27, 1995 to Anderson et al. Barthold teaches a suctioning and pumping toy employing a hollow body, nozzle, plunger and a toy article coupled to the nozzle. The toy article and nozzle cooperate to pass a malleable play material through the toy and nozzle to give the appearance of expelling and ingesting material by the toy article. Anderson teaches an activity toy for allowing a user to create art works with moldable materials extruded from a common toy extruder. Art work is captured between two plates for display.

Significantly, known syringe and extruder devices do not employ a simple yet unique coupling for pivoting a plunger rod between an unaligned position for fun and quick filling and refilling of a modeling compound and an aligned position for easy extruding of the modeling compound. Additionally, known devices do not employ storage cavities for partially containing the plunger rod in a folded position for quick and easy transport of the device. It would be desirable to provide a plunger handle and coupled plunger rod which easily swings between an aligned position and an unaligned position. The plunger handle traverses the plunger rod within a receptacle for extruding a contained modeling compound when the rod is aligned with the receptacle. The plunger handle swings the plunger rod to a position unaligned with the receptacle for easy and quick refilling of the receptacle with modeling compound. Additionally, it would be desirable to provide a storage cavity in one or more of the plunger handle and/or housing handle partially containing the plunger rod intermediate the plunger handle and housing handle for easy storage and transport.

SUMMARY OF THE INVENTION

The present invention addresses shortcomings of the prior art to provide a craft gun which simply yet uniquely pivots a plunger rod for easy extruding and quick refilling of a modeling compound in a receptacle. The craft gun also uniquely stores a pivoting plunger rod intermediate a plunger and housing handle for easy transport and storage of the craft gun. The hand held craft gun is simple to use and easy to store and transport yet provides a large variety of extruding options for a user.

In one embodiment of the invention, a hand held craft gun for extruding modeling compound includes a housing assembly including a housing handle housing assembly and a receptacle defined within the housing assembly, a plunger rod, a plunger handle for supporting the plunger rod, and a coupling at the plunger handle for pivoting the plunger rod between a position unaligned with the receptacle for filling and refilling a modeling compound at the receptacle and a position aligned with the receptacle for extruding the modeling compound.

In another embodiment of the invention, the coupling further includes a shaft disposed at the housing assembly, adjacent the receptacle, extending away from the housing handle and an aperture defined in the plunger handle through which the shaft penetrates, one of the shaft or handle aperture deviates slightly in size to create an interference fit between the mating shaft and handle aperture such that the plunger handle securely pivots the shaft aligning the plunger rod with the receptacle, and the plunger handle traverses the shaft traversing the plunger rod back and forth within the receptacle for extruding the modeling compound.

In another embodiment of the invention, the coupling further includes a cylindrical apparatus having a cross sectional axis configured to mate with the shaft for back and forth traversing of the cylindrical apparatus along the shaft, and wherein the aperture defined in the plunger handle for at least partially containing the cylindrical apparatus, and pivoting the plunger handle with respect to the cylindrical apparatus and traversing the plunger handle along the shaft.

In another embodiment of the invention, the aperture of the plunger handle further includes a curved surface comprising a curved rib along at least a part of the surface and wherein the cylindrical apparatus further includes an outer surface having a curved groove for mating with the curved rib to hold the cylindrical apparatus within the aperture during use. In still another embodiment of the invention, the cylindrical apparatus further includes at least one longitudinal separation along a length of the apparatus and further includes one or more living hinges along a length of the apparatus opposite at least one separation for easy assembling of the cylindrical apparatus onto the shaft. In still yet another embodiment, the unaligned plunger rod rests intermediate the plunger handle and housing handle keeping the plunger handle spaced a distance apart for the housing handle.

In yet another embodiment of the invention, at least one removable cartridge is received into the receptacle of the housing for containing the volume of modeling compound, the cartridge includes a cross section larger than a cross sectional thickness of the plunger rod. In another embodiment, the cartridge further includes a first end and a second end, and further includes a flange at the first end defining an inlet and a cartridge plunger disposed at, and plugging, the inlet, the second end further includes a narrowed outlet.

In still yet another embodiment of the invention, the second end of the cartridge includes a threaded surface and further includes a threaded extrusion tip screwed onto the second end for shaping the extruding modeling compound. In another embodiment, two or more extrusion tips having a variety of extruding shapes each interchangeable on the second end of the cartridge are further included, and in yet another embodiment, one or more art boards each containing a pattern on which the modeling compound is applied as desired by a user is further included.

In another embodiment of the invention, a hand held craft gun for extruding modeling compound includes a housing assembly including a housing handle on the housing and a shaft disposed at the housing assembly, adjacent the receptacle, and extending away from the housing handle, a receptacle defined within the housing assembly, a plunger rod, a plunger handle for supporting the plunger rod, and a pivoting and traversing coupling disposed on the shaft for supporting the plunger handle, for pivoting the plunger rod between a position unaligned with the receptacle and a position aligned with the receptacle, and for traversing the plunger rod back and forth within the receptacle when the plunger rod is aligned with the receptacle for extruding the modeling compound.

In another embodiment of the invention, a rail on the shaft is further included and the pivoting and traversing coupling includes a cylindrical apparatus having a cross sectional axis configured to mate with the rail for back and forth traversing of the rail. In another embodiment, an aperture defined in the plunger handle for at least partially containing the cylindrical apparatus and pivoting the plunger handle with respect to the cylindrical apparatus, is further included. The aperture further includes an angular surface comprising an angular rib along at least a part of the surface and the cylindrical apparatus further includes an outer surface having a radial groove for mating with the angular rib to hold the cylindrical apparatus within the aperture during use.

In yet another embodiment of the invention, the cylindrical apparatus further includes at least one longitudinal separation along a length of the apparatus and further includes one or more living hinges along a length of the apparatus opposite at least one separation for easy assembling of the cylindrical apparatus onto the rail of the shaft. In another embodiment, a removable cartridge received into the receptacle of the housing for containing the volume of modeling compound is further included. The cartridge includes a first end and a second end, and further includes a flange at the first end defining an opening and a cartridge plunger disposed at, and plugging, the opening, the second end further includes a narrowed outlet.

In another embodiment of the invention, a method for repeatedly loading and extruding a modeling compound from a hand held craft gun includes the steps of providing a housing assembly including a housing handle and a shaft disposed at the housing assembly, the shaft is extending away from the housing handle, defining a receptacle within the housing assembly, the receptacle having a first end and second end, providing a plunger handle including a plunger rod supported on the plunger handle, and coupling the plunger handle for pivoting and traversing in mechanical engagement with the shaft. Loading a modeling compound into the receptacle at the first end, swinging the plunger rod at the shaft to a position aligned with the receptacle, traversing the plunger rod within the receptacle toward the second end and extruding the modeling compound, then traversing the plunger rod in the reverse direction and out of the receptacle, swinging the plunger rod to a position unaligned with the receptacle, reloading modeling compound into the receptacle, and repeatedly swinging the plunger rod between positions aligned and unaligned with the receptacle for repeatedly extruding modeling compound from the receptacle and repeatedly reloading modeling compound into the receptacle.

In yet another embodiment of the invention, a removable cartridge containing the volume of modeling compound is further included and the method further includes the step of inserting the cartridge into the receptacle. In another embodiment, two or more removable cartridges each including a different colored modeling compound are further included and the method further includes the steps of interchanging the two or more removable cartridges within the receptacle as different colored modeling compounds are desired by a user.

In still yet another embodiment of the invention, the cartridge further includes a narrowed outlet at an end of the cartridge and a threaded portion at the narrowed outlet, and further including a threaded extrusion tip screwed onto the threaded portion of the narrowed outlet for shaping the extruding modeling compound. In another embodiment, two or more extrusion tips having a variety of extruding shapes are further included and the method further includes the steps of interchanging the two or more extrusion tips as different extruding shapes are desired by a user.

In an alternative embodiment of the invention, a portable craft gun for extruding modeling compound and folding for easy transport includes a housing assembly, a receptacle defined within the housing assembly, a housing handle on the housing assembly having a first end and a second end, the housing handle extending at the first end from the receptacle, and a first storage cavity extending along a length of the housing handle between the first end and the second end of the housing handle. The craft gun further includes a plunger rod, a plunger handle for supporting the plunger rod, the plunger handle having a first end and a second end, a second storage cavity extending along a length of the plunger handle between the first end and the second end of the plunger handle, a first coupling securing the plunger rod to the first end of the plunger handle for pivoting the plunger rod between a first extended position aligning the plunger rod with the receptacle and a second folded position resting the plunger rod intermediate the plunger handle and the housing handle, the plunger rod in the second folded position is partially contained within both first and second storage cavities keeping the plunger handle spaced apart from the housing handle and a second coupling mechanically connecting the second end of the plunger handle to the second end of housing handle for pivoting the plunger handle between a first extruding position aligning the plunger rod in the extended position within the receptacle for extruding a modeling compound, and to a second storage position pivoting the plunger handle to a position adjacent the housing handle for storing the plunger rod in the folded position and partially within first and second storage cavities for easy transport.

In another embodiment, one or more of the first and second storage cavities includes an inner surface and further comprises one or more ridge elements affixed to the inner surface for abutting against the plunger rod in the folded position keeping the plunger rod spaced apart from the inner surface and the plunger handle spaced a distance apart from the housing handle when the plunger handle is in the storage position.

In another embodiment, the inner surface of the first storage cavity further comprises two or more ridge elements affixed to the inner surface, the two or more ridge elements rising to different heights from the inner surface of the first storage cavity. In yet another embodiment, the inner surface of the second storage cavity further comprises two or more ridge elements affixed to the inner surface, the two or more ridge elements rising to different heights from the inner surface of the second storage cavity.

In another embodiment, the second coupling further comprises a curved C-shaped element affixed to the second end of the plunger handle linking with and pivoting on a rod element affixed to the second end of the housing handle. In another embodiment, at least one removable cartridge received into the receptacle of the housing for containing a volume of modeling compound is further included, the cartridge including a cross section larger than a cross sectional thickness of the plunger rod.

In yet another embodiment, the cartridge includes a first end and a second end, and further includes a flange at the first end defining an opening and a cartridge plunger disposed at, and plugging, the opening, the second end further includes a narrowed outlet. In still yet another embodiment, the cartridge plunger includes an inside surface contacting the modeling compound and an outside recessed surfaced for capturing the plunger rod, and further comprising two or more self-centering ridges at the outside recessed surface of the cartridge plunger for centering the plunger rod on the cartridge plunger for easy and efficient extruding to the modeling compound, and in still yet another embodiment, two or more extrusion tips having a variety of extruding shapes each interchangeable on the second end of the cartridge is further included.

In another embodiment, one or more view holes in the housing assembly at the receptacle is further included. The one or more view holes are aligned along a length of the receptacle for viewing the volume of modeling compound contained within the cartridge inserted into the receptacle.

In another embodiment of the invention, a method for folding a hand held craft gun upon itself for easy transport includes the steps of providing a housing assembly including a housing handle, the housing handle having a first end and a second end, defining a first storage cavity along a length of the housing handle between the first end and the second end of the housing handle, providing a plunger handle coupled to the housing handle and supporting a plunger rod, the plunger handle having a first end and a second end, defining a second storage cavity along a length of the plunger handle between the first end and the second end of the plunger handle, and providing a first coupling securing the plunger rod to the plunger handle for pivoting the plunger rod between a first extended position and a second folded position. The further step of pivoting the plunger rod to the second folded position contains the plunger rod partially within the second storage cavity for easy transport of the portable craft gun.

In another embodiment of the invention, the method further includes the steps of providing a second coupling mechanically connecting the plunger handle to the housing handle for pivoting the plunger handle between a first extruding position and a second storage position, and pivoting the plunger handle to the second storage position disposing the plunger handle adjacent the housing handle partially containing the plunger rod within both the first and second storage cavities resting the plunger rod intermediate the plunger handle and the housing handle for folding the craft gun upon itself for easy transport.

In yet another embodiment, one or more of the first and second storage cavities further includes an inner surface and the method further includes one or more ridge elements affixed to the inner surface for abutting against the plunger rod in the folded position keeping the plunger rod spaced apart from the inner surface and the plunger handle spaced apart from the housing handle when the plunger handle is in the storage position.

BRIEF DESCRIPTION OF THE DRAWINGS

For the purpose of facilitating an understanding of the inventions, the accompanying drawings and description illustrates a preferred embodiment thereof, from which the inventions, structure, construction and operation, and many related advantages may be readily understood and appreciated.

FIG. 1B illustrates the plunger handle pivoting the plunger rod to a position aligned with the receptacle of the housing; while

FIG. 3A is an enlarged perspective view of a pivoting and traversing coupling of the present invention illustrating a cylindrical apparatus as one piece and including a living hinge along a length of the apparatus; while

FIG. 4B illustrates the plunger handle pivoting the plunger rod to a position aligned with the receptacle of the housing; while

FIG. 7A is a perspective view of an extrusion tip of the present invention screwed onto a threaded end of the cartridge and illustrating an extrusion shape; while

FIG. 9A is a perspective view of an alternative embodiment of a craft gun of the present invention illustrating a plunge handle supporting a plunger rod pivoted to a first extended position aligned with a receptacle of a housing assembly, while FIG. 9C illustrates the plunger rod pivoted to a second folded position and partially contained within a storage cavity of the plunger handle, while

FIG. 11A illustrates a second storage cavity extending along a length of the plunger handle and including ridge elements at an inner surface of the second storage cavity with the plunger rod in the first extended position, while

FIG. 15A illustrates a removable cartridge containing a volume of modeling compound and including a flange defining an opening and including cartridge plunger disposed at and plugging the opening, while

DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1A:
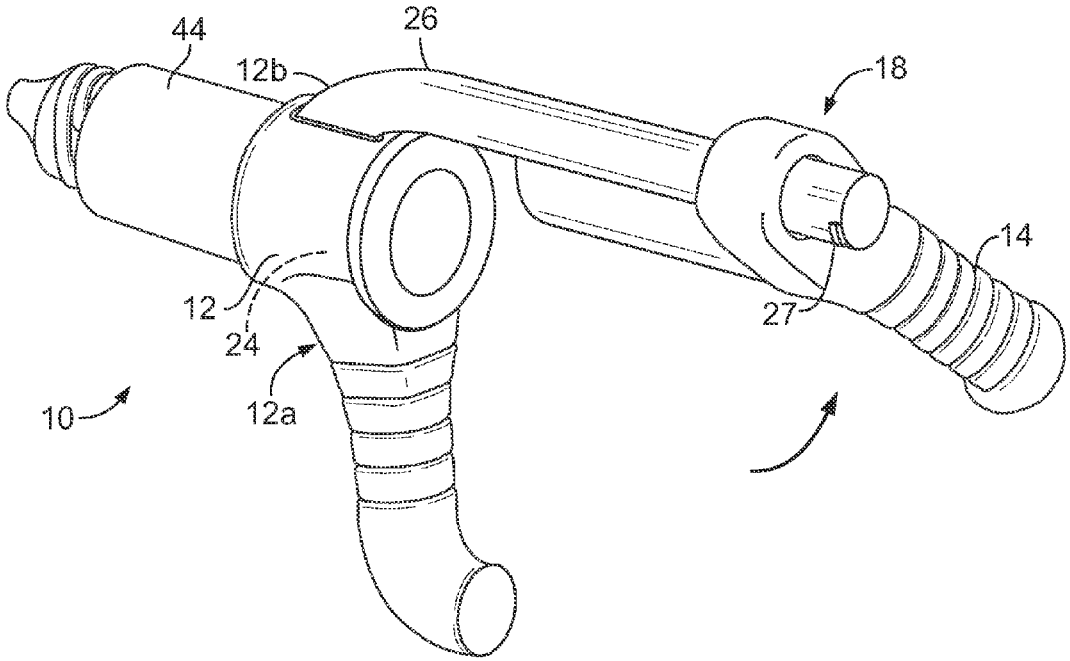
FIG. 1A is a perspective view of a craft gun of the present invention illustrating a plunger handle supporting a plunger rod and pivoting the plunger rod to a position unaligned with a receptacle of a housing assembly.
Figure 1B:
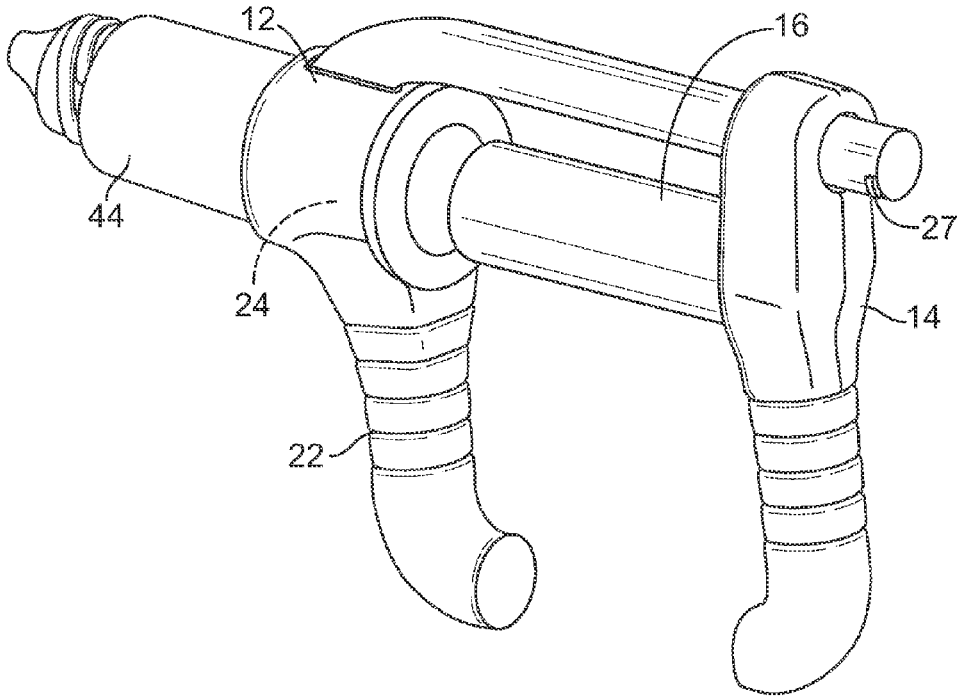
Figure 1C:
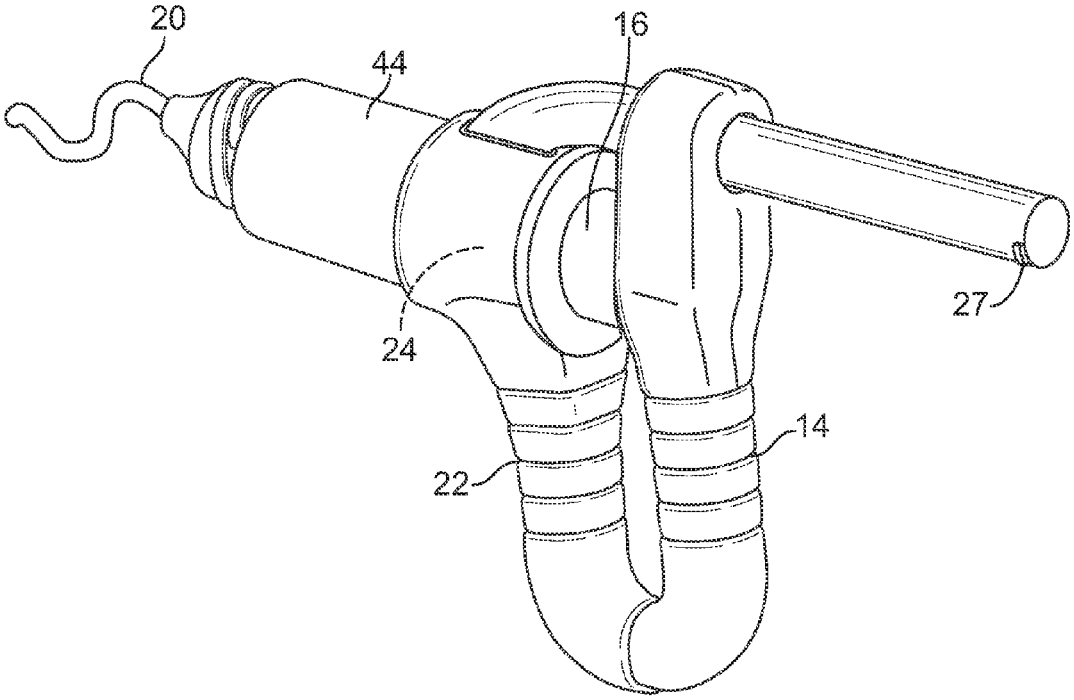
FIG. 1C illustrates the plunger handle traversing a shaft of the housing and traversing the plunger rod back and forth within the receptacle when the plunger rod is aligned with the receptacle for extruding a modeling compound.

A craft gun 10, as shown in FIGS. 1A-1C, is generally seen to include a housing assembly 12 and a plunger handle 14 supporting a plunger rod 16 and employing a simple yet unique coupling 18 for pivoting the plunger rod between an unaligned position for fun and quick filling and refilling of a modeling compound 20 and an aligned position for easy extruding of the modeling compound. The craft gun 10 further includes a housing handle 22 on the housing assembly that aligns with the plunger handle 14 when extruding the compound 20 and provides for a comfortable craft gun easy to hold in one hand during use.

Figure 2:
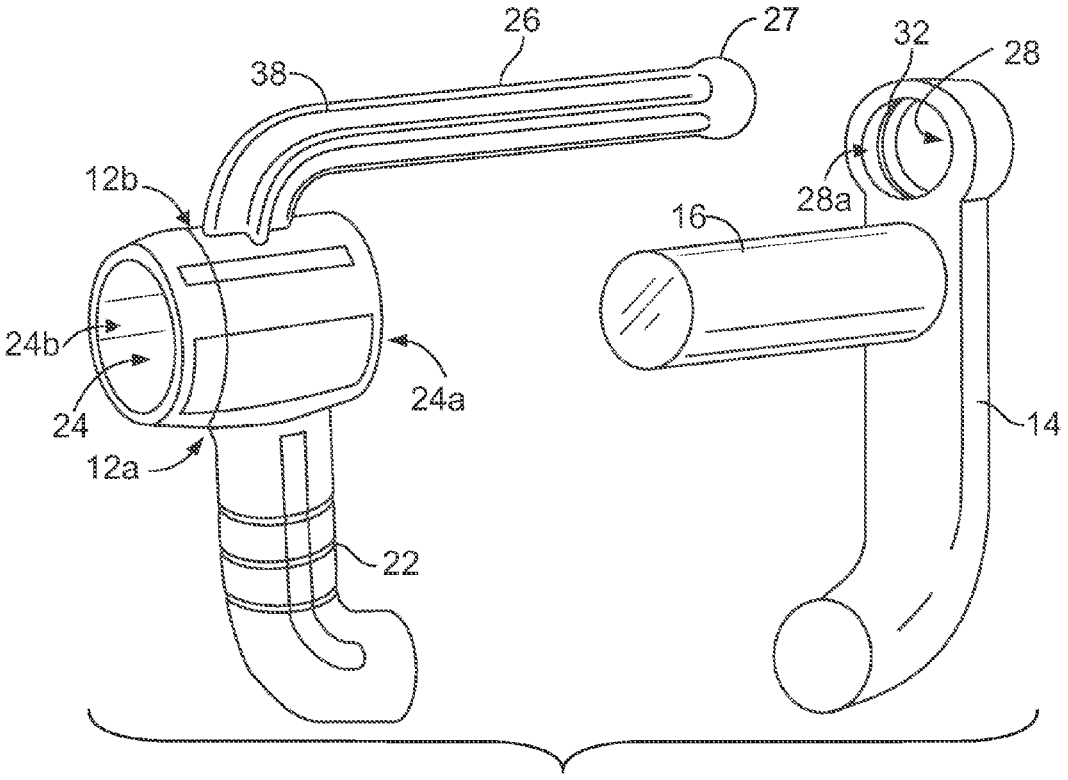
FIG. 2 is an exploded view of the housing assembly and plunger handle of the present invention illustrating the receptacle of the housing assembly and the aperture of the plunger handle.

The housing assembly 12, as seen in FIGS. 1A-1C, includes a first end 12*a* and a second end 12*b*, with the housing handle 22 disposed on the first end 12*a* of the housing assembly. A receptacle 24 is defined within the housing assembly, as best seen in FIG. 2, and a shaft 26 is disposed at the housing assembly at the second end 12*b*, adjacent the receptacle 24, and extending away from the housing handle 22. The receptacle 24 includes a first end 24*a* and a second end 24*b*, as best seen in FIG. 2, such that the plunger rod 16 traverses the receptacle 24 back and forth between the first and second ends, 24*a*-24*b* respectively.

In the present described embodiment, the housing assembly 12 is a single piece, manufactured from a heavy duty molded plastic material which is simple and inexpensive to manufacture into any desired shape and can easily include fun and interesting colors and patterns. Molded plastic is strong and rigid enough to maintain its shape and integrity after many years of use and can also be clear and see through allowing a child user to delight in watching the extruding of a moldable compound from the receptacle.

Figure 4A:
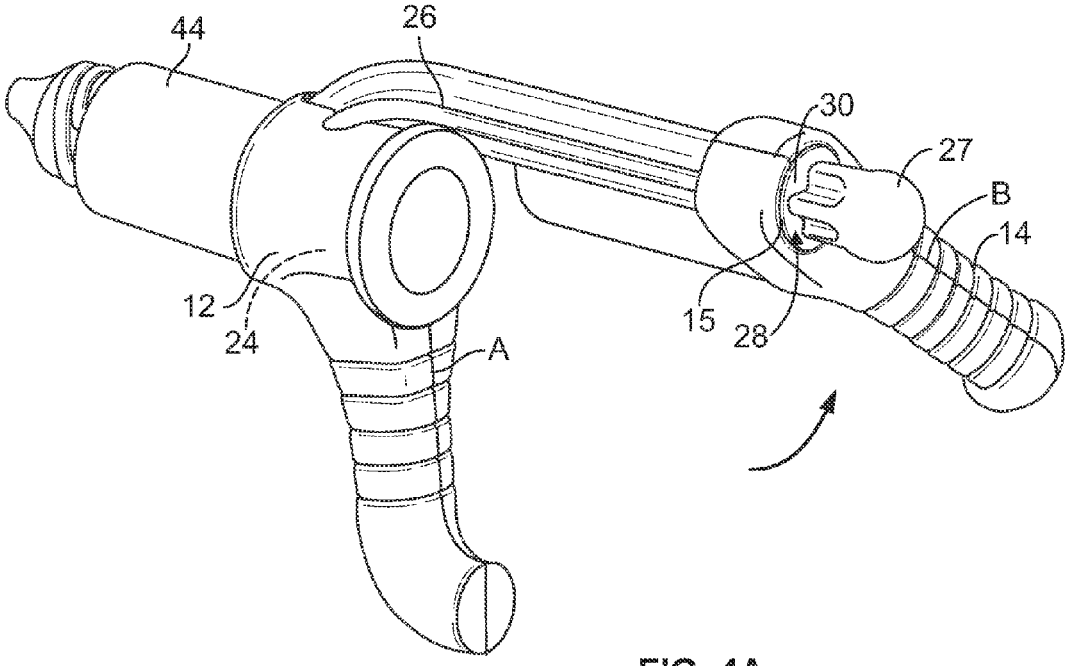
FIG. 4A is a perspective view of a craft gun of the present invention, illustrating the cylindrical apparatus contained within the aperture of the plunger handle supporting the plunger rod and pivoting the plunger rod to a position unaligned with the receptacle of the housing assembly.
Figure 4B:
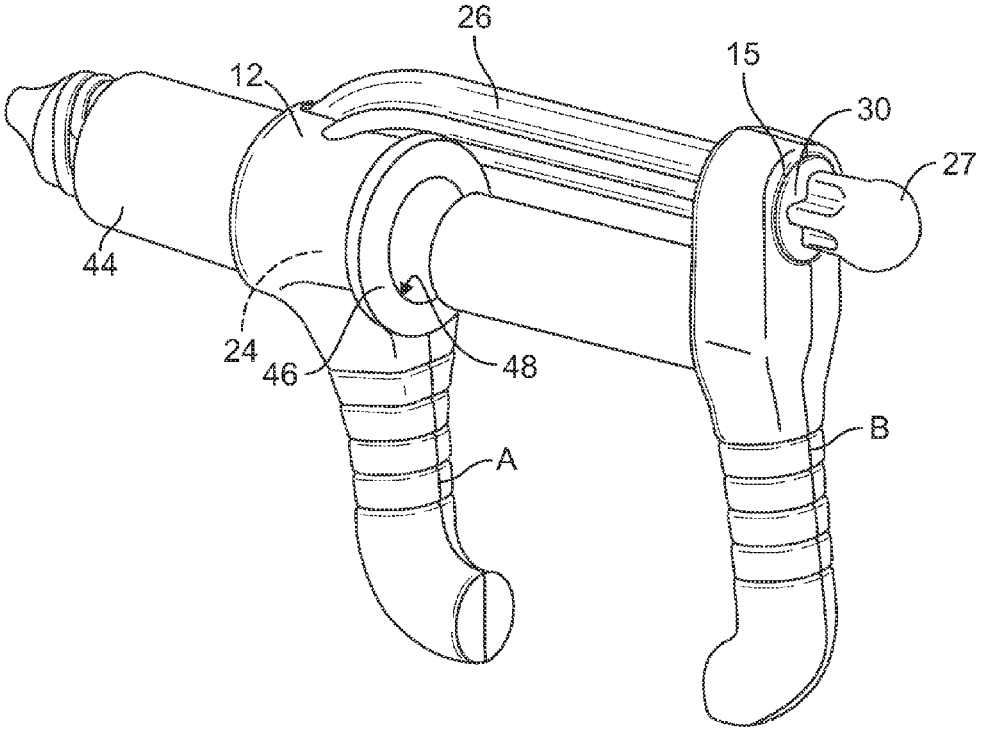
Figure 4C:
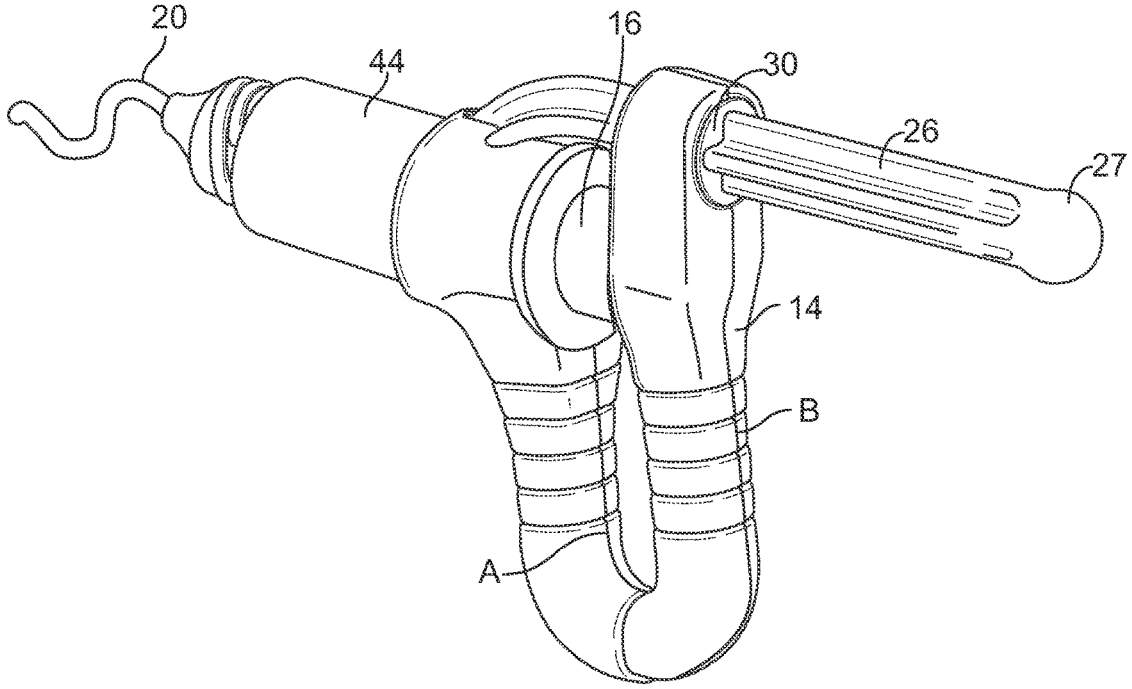
FIG. 4C illustrates the plunger handle traversing the shaft of the housing and traversing the plunger rod back and forth within the receptacle when the plunger rod is aligned with the receptacle for extruding the modeling compound.

The housing handle 22 and shaft 26 are molded from the same heavy duty plastic material as the housing assembly, as described above. In the present described embodiment, the housing handle 22 is assembled from two separate handle halves (split along line A) coupled together, as seen in FIGS. 4B-4C. The two halves of the housing handle 22 capture a portion of the housing assembly 12 between the handle halves for coupling the housing handle to the housing assembly. Alternatively, it is also contemplated that the housing handle 22 is molded and integral with the housing assembly 12 and/or includes alternative materials such as wood or metal.

Likewise, the plunger handle 14 and supported plunger rod 16 are also molded from the same heavy duty plastic material as the housing assembly. In the present described embodiment, the plunger handle 14 is assembled from two separate handle halves (split along line B) coupled together, as seen in FIGS. 4B-4C. The two halves of plunger handle 14 capture the pivoting and traversing coupling 18 within the handle halves as the handle 14 is mounted on the shaft 26. Additionally, the plunger handle 14 captures a portion of the plunger rod 16 between the two halves of the plunger handle 14 for coupling the plunger rod to the handle 14. Alternatively, it is also contemplated that the plunger rod 16 is molded and integral with the plunger handle 14, and/or includes alternative materials such as wood or metal.

The coupling 18, at the plunger handle 14 pivots the plunger rod between a position unaligned with the receptacle for filling and refilling a modeling compound, as seen in FIG. 1A, and a position aligned with the receptacle for extruding the modeling compound, as seen in FIGS. 1A-1B. In a presently described alternative embodiment, the unaligned plunger rod rests intermediate the plunge handle and the housing handle keeping the plunger handle spaced a distance apart from the housing handle.

In the present described embodiment, the coupling 18, as seen in FIGS. 1A-1C, mechanically engages the shaft 26 and the plunger handle 14 for pivoting the plunger rod 16 between a position unaligned with the receptacle 24 and a position aligned with the receptacle 24, and for traversing the plunger rod 16 back and forth within the receptacle when the plunger rod is aligned with the receptacle for extruding the modeling compound.

A user easily pivots the plunger handle 14 out of alignment with the housing handle 22, as seen in FIG. 1A, swinging the plunger rod 16 (in either a clockwise or counter clockwise direction) to a position unaligned with the receptacle for easy filling and/or refilling of the receptacle with modeling compound 20. The user then easily swings/pivots the plunger handle 14 into alignment with the housing handle 22, as seen in FIG. 1B, swinging the plunger rod 16 to a position aligned with the receptacle, and then simply extrudes the modeling compound by traversing the plunger rod within the receptacle when the plunger handle 14 is squeezed toward the housing handle 22, as seen in FIG. 1C.

Figure 6:
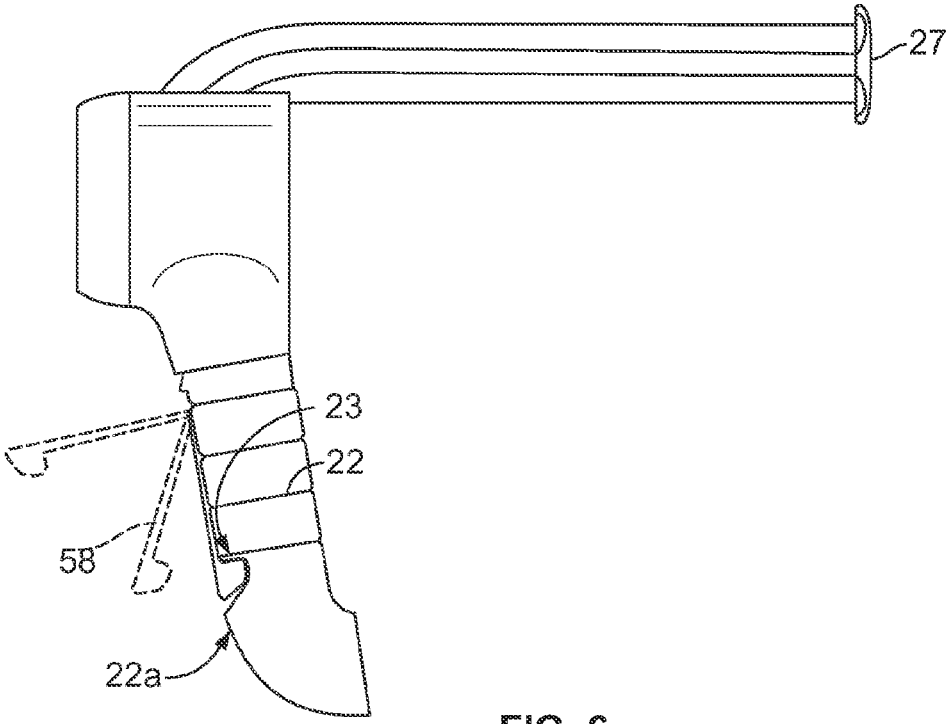
FIG. 6 illustrates a stop element at the shaft at an end opposite the housing assembly, and further illustrates a stand at the housing handle pivotable between a storage position in a recess of the handle and an open position extending away from the housing handle to stand the craft gun on a surface during use.

A stop element 27 is disposed at the shaft 26 and is employed to prevent the handle 14 from disengaging from the shaft 26 during use, as seen in FIGS. 1A-1C. The stop element 27 can include a variety of shapes and sizes, including a clip, as seen in FIGS. 1A-1C, a flat extending surface of the shaft 26, as seen in FIG. 6, as well as a ballooning out ball shaped stop integral with the shaft 26, as seen in FIGS. 4A-4C.

In the present described embodiment, the coupling 18 includes the aperture 28 defined in the plunger handle 14 through which the shaft 26 penetrates, as seen in FIG. 2, mechanically engaging the plunger handle 14 and shaft 26. One of the shaft 26 or handle aperture 28 deviates slightly in size to create an interference fit between the mating shaft and handle aperture such that the plunger handle securely pivots the shaft aligning the plunger rod with the receptacle, and the plunger handle traverses the shaft traversing the plunger rod back and forth within the receptacle for extruding the modeling compound, as seen in FIGS. 1A-1C.

The interference fit is achieved by shaping one of the mating shaft or aperture to slightly deviate in size from a normal dimension, such that one of the shaft or aperture slightly interferes with the space that the other would otherwise occupy. The tightness of the (combined shaft and aperture) coupling 18 is controlled by the amount of interference that exists between the two mating elements and can be achieved, for example, by increasing the cross sectional thickness of the shaft 26, or adding an elongated rib element along an outer surface of the shaft, or any other similar means by which the shaft 26 cross sectional thickness can be increased. Alternatively, the cross section of the aperture 28 can be narrowed to create the interference fit between the shaft and aperture (coupling 18) with the narrowed aperture interfering with the space that the shaft would have otherwise occupied.

Figure 3A:
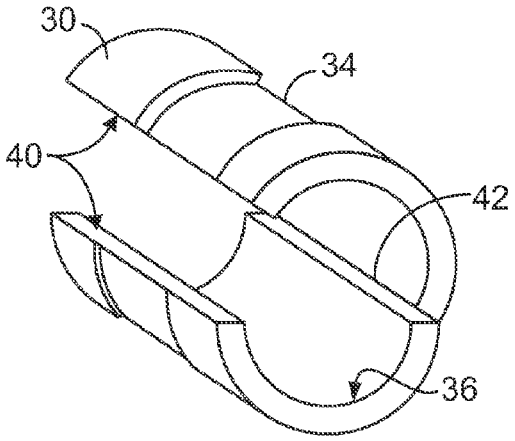
Figure 3B:
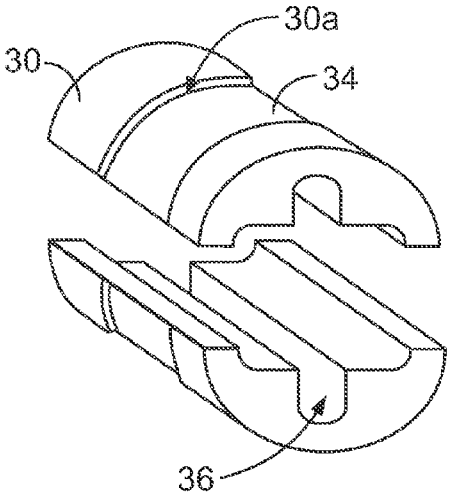
FIG. 3B illustrates the cylindrical apparatus separated into two pieces and including a cross shaped axis.

In the present described embodiment, the coupling 18 further includes a cylindrical apparatus 30, as seen in FIGS. 3A & 3B, and the second pivoting and traversing coupling 18 is disposed on the shaft 26 for supporting the plunger handle 14. The cylindrical apparatus 30 includes a cross sectional axis configured to mate with the shaft for back and forth traversing of the cylindrical apparatus 30 along the shaft 26. The cylindrical apparatus 30 is at least partially contained within the handle aperture 28 for pivoting the plunger handle 14 with respect to the cylindrical apparatus 30, as seen in FIGS. 4A-4B, and traversing the plunger handle along the shaft, as seen in FIG. 4C.

In the present described embodiment, the cylindrical apparatus 30 wraps around the shaft 26 and is held captive within the handle aperture 28. The cylindrical apparatus 30 includes a channel or central axis 36 through the length of the apparatus 30 to accommodate the size and shape of the shaft 26 on which the apparatus 30 is mounted. The handle 14 further includes a lip 15 that curves over at least a portion of the cylindrical apparatus 30 when contained within the aperture 28 to further assist in holding the apparatus 30 secure within the handle aperture 28, as seen in FIGS. 4A-4C. Additionally, the handle aperture 28 further includes a curved surface 28*a* (or angular surface) including a curved rib 32 (or angular rib) along at least a part of the surface, as seen in FIG. 2, and the cylindrical apparatus 30 further includes an outer surface 30*a* having a curved groove 34 (or radial groove) for mating with the curved rib 32 (or angular rib) to hold the cylindrical apparatus within the aperture during use, as seen in FIGS. 3A & 3B.

The cylindrical apparatus 30 mounts the plunger handle 14 onto the shaft 26, as seen in FIGS. 4A-4B, and includes an axis/central aperture 36 shaped to mate with the configuration or cross sectional shape of the shaft 26. Apparatus 30 can have a cross sectional axis/central aperture 36 including any variety of shapes depending upon the cross sectional shape of the shaft 26 on which it mounts. As seen in FIG. 3A, axis/central aperture 36 has a circular cross sectional shape in order to effectively mate with the circular cross sectional shape of shaft 26 as seen in FIGS. 1A-1C.

In the present described embodiment, a rail 38, as seen in FIG. 2, is further included on the shaft 26 and the cylindrical apparatus 30 (coupling 18) further includes a cross sectional axis/central aperture 36 configuration to mate with the rail 38 for back and forth traversing of the rail, as seen in FIG. 4C. Keeping a spaced apart distance between the plunger handle and the housing handle provides an anti-pinching mechanism between the handles and helps prevent the child user from pinching their fingers between the handles. As seen in FIG. 3B, axis/central aperture 36 of the apparatus 30 includes a cross shaped or X shaped cross section for effectively mating with rail 38 of shaft 26, as seen in FIGS. 4A-4C.

In the present described embodiment, the cylindrical apparatus 30 can be separated into two parts or two halves, as seen in FIG. 3B, for easy assembling of the cylindrical apparatus 30 onto the shaft 26 during the manufacture of the craft gun 10. Alternatively, the cylindrical apparatus can further include at least one longitudinal separation 40 along a length of the apparatus and further include one or more living hinges 42 along a length of the apparatus opposite at least one separation, as seen in FIG. 3A. The living hinge 42 includes a thinned flexible strip of the same material used to manufacture the cylindrical apparatus 30 for easy opening and closing of the apparatus 30 at the living hinge, again for easy assembling of the cylindrical apparatus onto the shaft during manufacture. The cylindrical apparatus 30 is generally manufactured from a durable plastic material, as described above, and the living hinge includes a thin flexible strip of the same plastic material along the length of the apparatus 30, as seen in FIG. 3A.

In the present described embodiment, at least one removable cartridge 44 is received into the receptacle 24 of the housing 12 for containing the volume of modeling compound 20, as seen in FIGS. 1A-1C & 4A-4C. The cartridge 44 includes a cross section larger than a cross sectional thickness of the plunger rod 16, such that the plunger rod 16 can traverse back and forth within the cartridge for extruding the contained modeling compound.

Figure 5A:
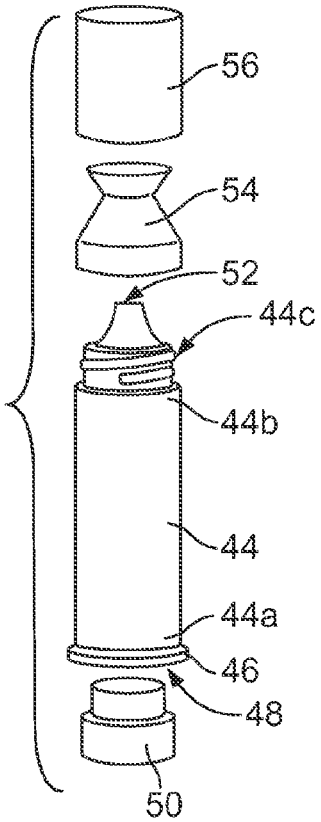
FIG. 5A is a perspective view of a removable cartridge of the present invention illustrating a cartridge flange, plunger and threaded end with a threaded extrusion tip shown for mating with the threaded end; and 5B illustrates the cartridge shown together and packaged for sale or storage.

The cartridge 44 can include a variety of shapes and sizes capable of being received into the receptacle of the housing 12, and the cartridge can be manufactured from a variety of materials such as plastic, etc. and even clear materials such as a clear plastic, so that a child user may view colored modeling compound contained in and extruded from the cartridge. The cartridge 44 also includes a first end 44*a* and a second end 44*b*, as seen in FIG. 5A, and further includes a flange 46 at the first end 44*a* defining an inlet 48. The cartridge 44 is received into the receptacle 24 such that the flange 46 abuts the first end 24*a* of the receptacle, as seen in FIGS. 2 & 4A-4C. Cartridge 44 can be prefilled with modeling compound 20 prior to insertion of the cartridge into the receptacle 24, or alternatively, modeling compound can be filled into the cartridge while the cartridge is already in the receptacle because the plunger rod can be quickly and easily swung out from alignment with the receptacle allowing the user access to the inserted cartridge for filling and/or refilling.

The cartridge 44 further includes a cartridge plunger 50 disposed at, and plugging, the inlet 48, as seen in exploded view FIG. 5A. The cartridge plunger 50 seals modeling compound in the cartridge for convenient storing of compound in the cartridge and for creating a firm platform on which the plunger rod can apply a force for effective extruding of the compound from the cartridge.

Figure 5B:
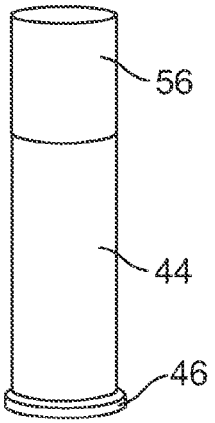

Additionally, the cartridge 44 includes a narrowed outlet 52 at the second end 44*b*, and the second end further includes a threaded surface 44*c*, as seen in FIG. 5A. A threaded extrusion tip 54 is further screwed onto the threaded surface of the second end 44*b* for shaping the extruding modeling compound. A cap 56 is also included to seal off the outlet 52 of the cartridge for convenient storing of the compound within the cartridge 44, and easy transportation and sale of prefilled cartridges, as seen in FIG. 5B.

Two or more removable cartridges are further included, and in the present described embodiment, multiple cartridges can be prefilled with an assortment of colored modeling compounds and sold individually or together or even with a bigger craft or extrusion kit. Multiple prefilled cartridges provide a significant advantage to the user, especially a child user, who can avoid the need to clean cartridges between refilling with different colored modeling compounds, making it easier to change colors during use.

In use, the prefilled removable cartridges 44 can be easily and quickly interchanged at the housing receptacle 24 enhancing the creative experience for a user who can extrude multiply varieties and/or colors of modeling compound quickly and easily during a single art project. Further, a pivoting stand 58, as seen in FIG. 6, is included at the housing handle 22 and stored in a recess 23 of the handle, flush with an outer surface 22*a* of the handle 22, to eliminate any interference the stand 58 might otherwise have with the use of the handle 22. The stand 58 pivots between a stored position within recess 23 of handle 22, and an open position extending out and away from handle 22, as seen in FIG. 6, to rest on a surface and stand up the craft gun 10 during use.

Figure 7A:
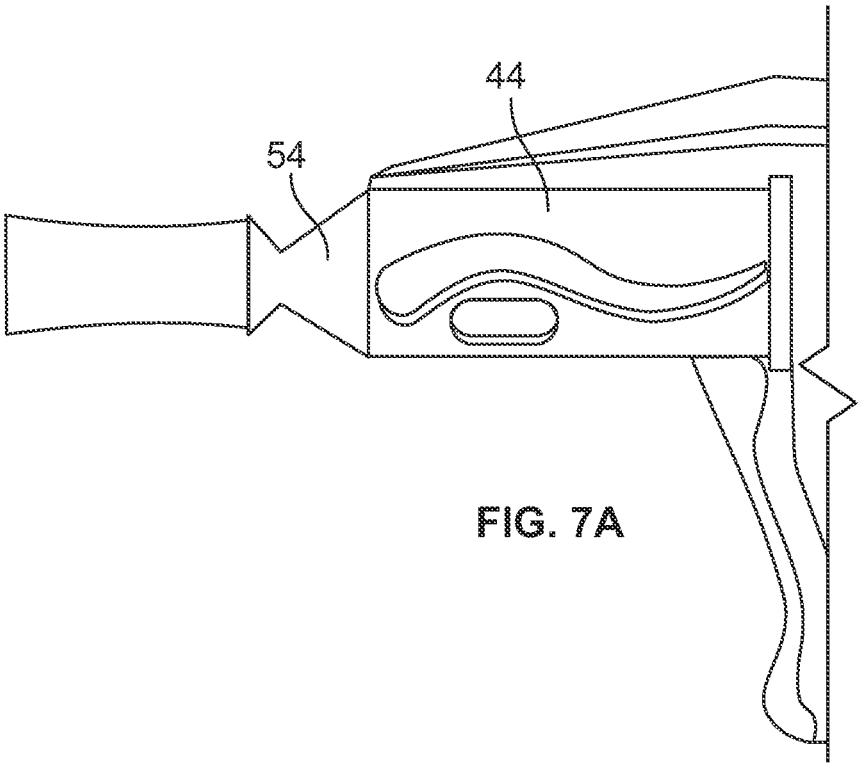
Figure 7B:
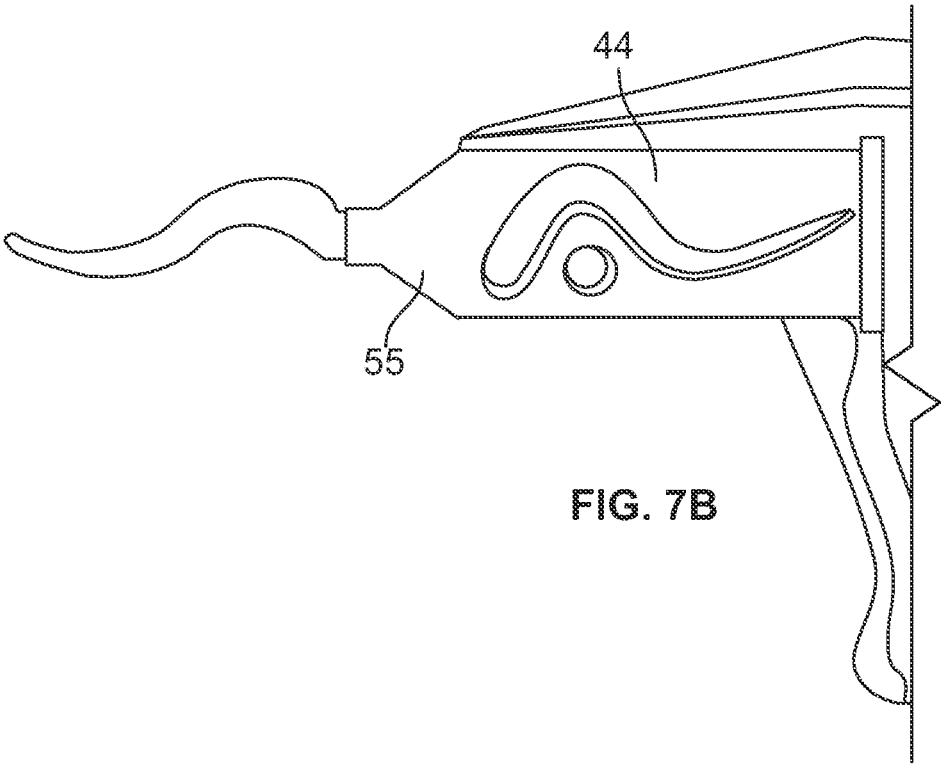
FIG. 7B illustrates an alternative extrusion tip integral with the cartridge and illustrating an alternative extrusion shape.
Figure 8:
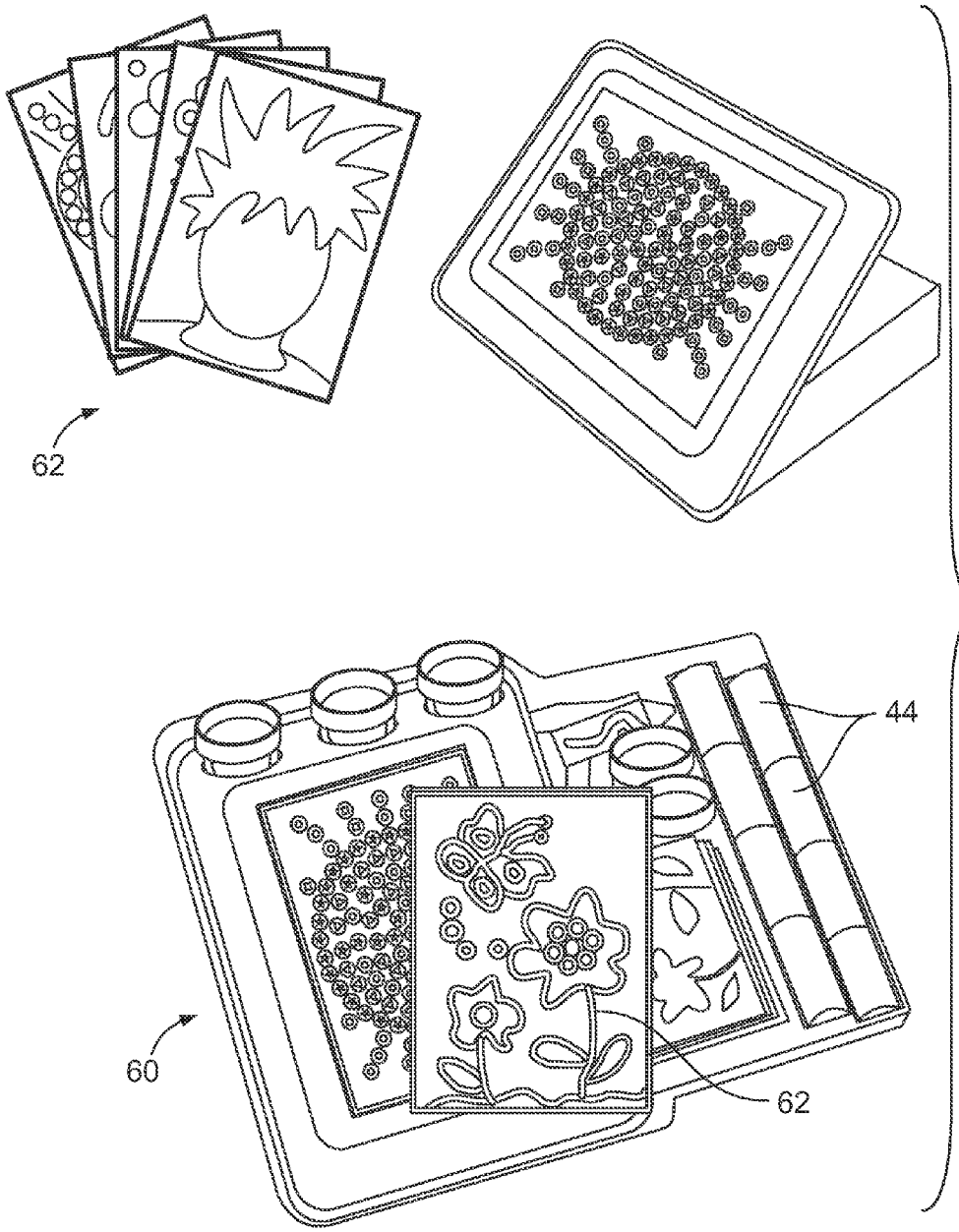
FIG. 8 illustrates one or more art boards containing a pattern on which the modeling compound is applied and an easel kit including art boards and refillable cartridges of modeling compound.

In the present described invention, two or more extrusion tips 54, having a variety of extruding shapes each interchangeable on the second end 44*b* of the cartridge 44 are further included, as seen in FIGS. 7A-7B. Each extrusion tip 54 can be screwed onto the threaded second end of the cartridge as seen in FIGS. 5A & 7A, extruding particular shapes from the outlet 52 of the cartridge. Alternatively, an extrusion tip 55 can be integral with the cartridge, as seen in FIG. 7B, providing for a fixed extruding shape from each particular cartridge. The combination of multiple prefilled cartridges, including a variety of colored modeling compounds, with a number of interchangeable and replaceable extrusion tips for making different line patterns, provides numerous artistic opportunities for the user to easily produce creative works that are fun to make.

In the present described embodiment, the craft gun 10 can be combined with a larger craft kit 60 to enhance the enjoyment of creating artistic crafts. The craft kit 60 contains one or more art boards 62 each containing a pattern on which the modeling compound is applied as desired by the user. The craft kit 60 can also function as an easel for further ease in applying modeling compound to the art boards.

In a presently described preferred embodiment, a portable craft gun 200, as seen in FIGS. 9A-9D, is generally seen to include a housing handle 210 extending from a housing assembly 212, a plunger handle 214 supporting a plunger rod 216 and a simple yet unique storage cavity disposed at the plunger handle and/or the housing handle for storing the plunger rod pivoted to a folded position and resting intermediate the plunger and housing handles for quick and easy transport of the portable craft gun. The craft gun further includes a first coupling 220 at the plunger handle for pivoting the plunger rod between a first extended position and a second folded position, and a second coupling 222 connecting the plunger handle to the housing handle and pivoting the plunger handle between a first extruding position for extruding a modeling compound 218 and a second storage position for easy transport of the craft gun.

Figure 10:
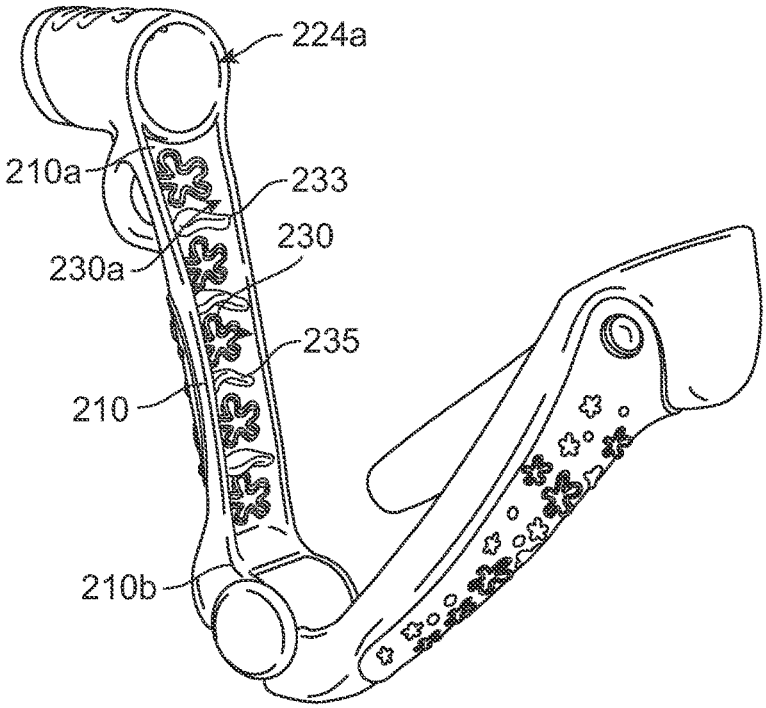
FIG. 10 illustrates a first storage cavity extending along a length of the housing handle and including ridge elements at an inner surface of the first storage cavity.
Figure 11A:
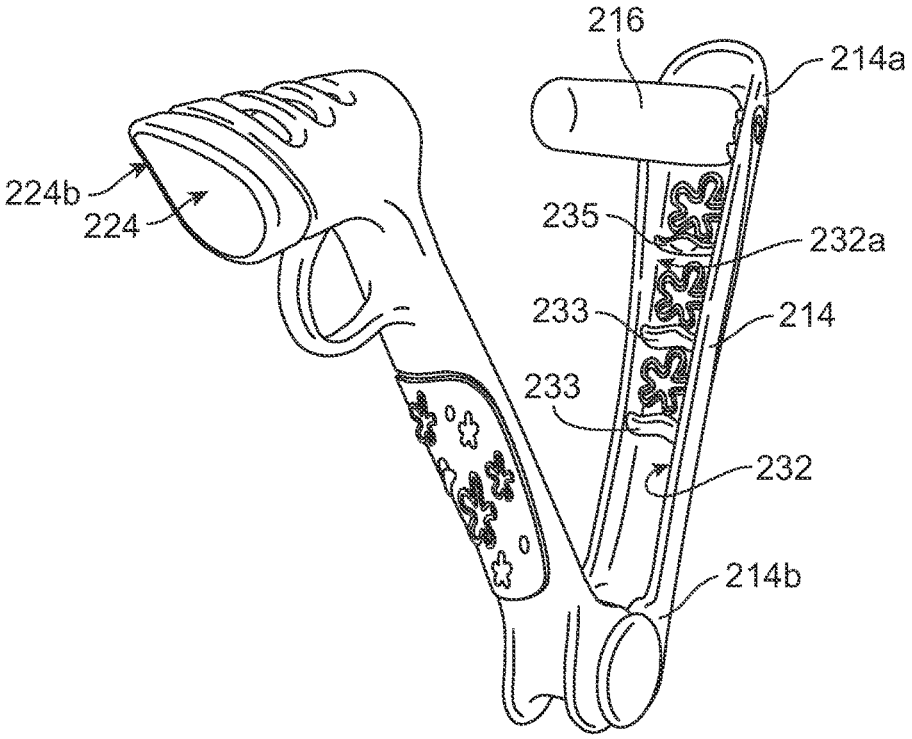
Figure 11B:
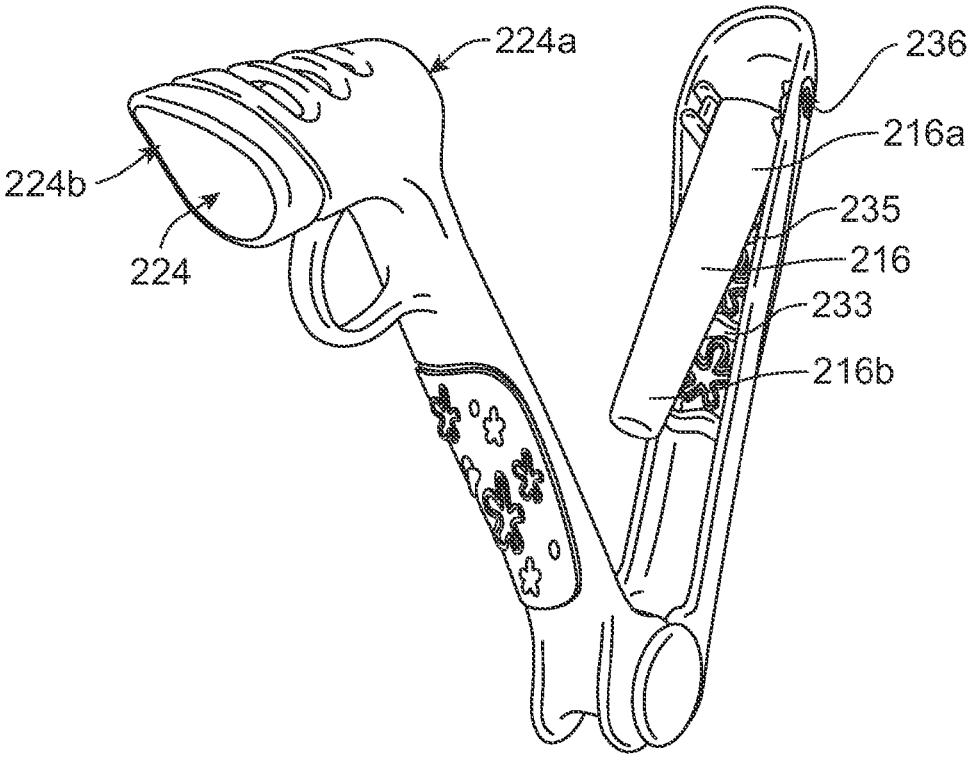
FIG. 11B illustrates the plunger rod pivoted to the second folded position and partially contained within the second storage cavity.

The housing assembly 212, as seen in FIGS. 9A-9D, includes a first end 212*a* and a second end 212*b*. A receptacle 224 is defined within the housing assembly and is best seen in FIGS. 10 and 11. The receptacle 224 includes a first end 224*a* and a second end 224*b*, as best seen in FIGS. 11A-11B, such that the plunger rod 216 traverses the receptacle back and forth between the first and second ends, 224*a* and 224*b* respectively.

In the presently described embodiment, the housing assembly 212 is a single piece, manufactured from a heavy duty molded plastic material which is simple and inexpensive to manufacture into any desired shape and can easily include fun and interesting colors and patterns. Molded plastic is strong and rigid enough to maintain its shape and integrity after many years of use and can also be clear and see through allowing a child user to delight in watching the extruding of moldable compound from the receptacle.

The housing handle 210 is disposed on the housing assembly and extending from the receptacle 224. The housing handle includes a first end 210*a* and a second end 210*b* and is also molded from the same heavy duty plastic material as the housing assembly, as described above. In the present described embodiment, the housing handle 210 is molded and integral with the housing assembly 212. Alternatively, it is also contemplated that the housing handle 210 can be affixed to the housing assembly and/or include alternative materials such as wood or metal.

A trigger-like loop 226 is disposed at a first end of the housing handle and is also integral with the housing handle 210 and the housing assembly 212. The trigger-like loop has a central opening 227, allowing the user's finger to pass through the loop's opening and wrap around the housing handle 210 providing the user with a firm hold on the craft gun. Additionally, a raised grip element 228 is positioned at the housing handle adjacent the loop 226 to further assists the user in securely gripping the craft gun while extruding the moldable compound, as seen in FIG. 9B.

A first storage cavity 230 is disposed at the housing handle 210 and extends along a length of the housing handle, as seen in FIG. 10. The first storage cavity 230 extends between the first end 210*a* and the second end 210*b* of the housing handle and, in the present described embodiment, the first storage cavity 230 is integral with and molded within the housing handle and manufactured from the same heavy duty plastic material. Alternatively, an elongated area along a length of the housing handle 210 between the first end 210*a* and the second end 210*b* can be carved out and removed to form the first storage cavity 230. Additionally, the first storage cavity 230 is sized and shaped to partially contain the plunger rod 216 when the plunger rod is in a folded position, as seen in FIGS. 9C and 9D.

Figure 9A:
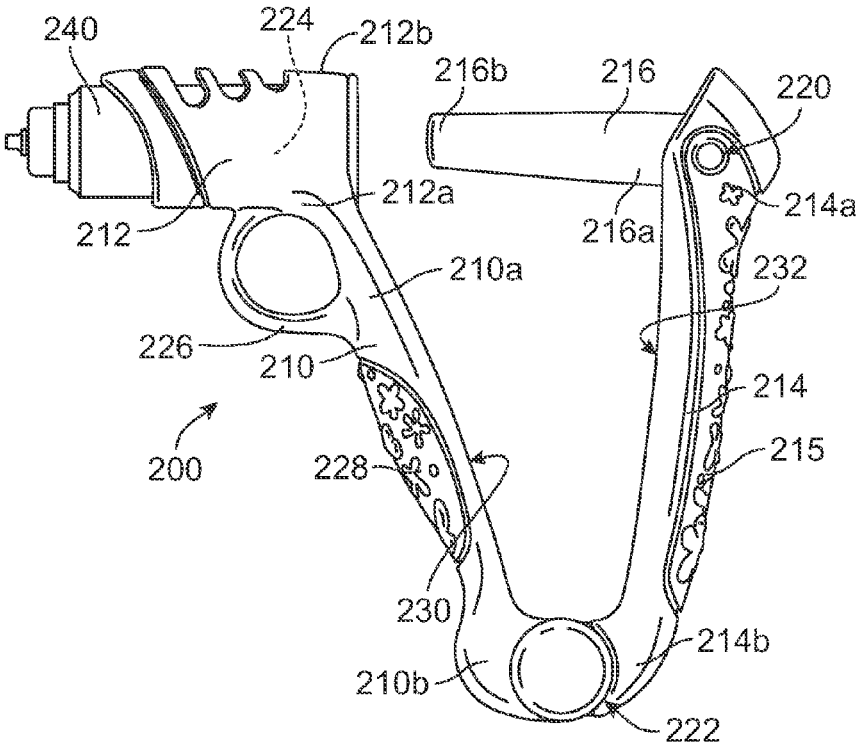
Figure 9B:
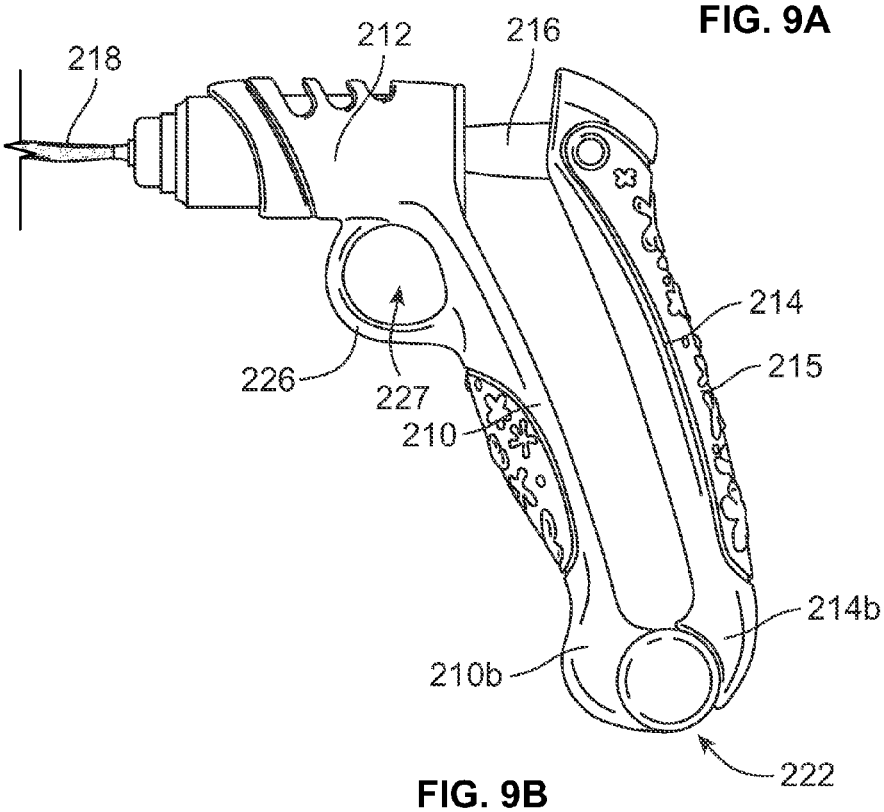
FIG. 9B illustrates the plunger handle pivoted to a first extruding position with the extended plunger rod within the receptacle and extruding a modeling compound.
Figure 9C:
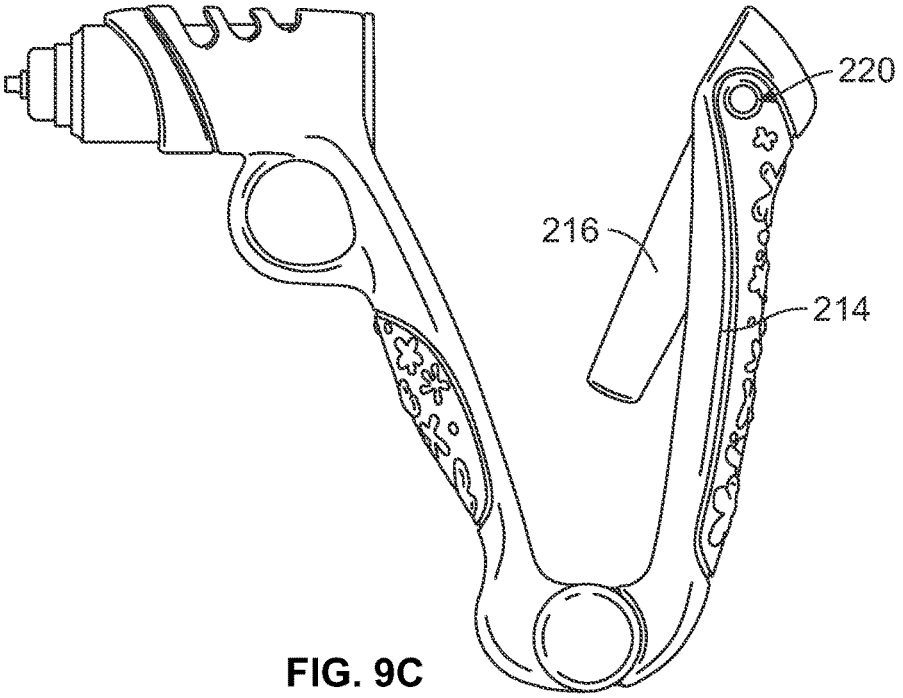
Figure 9D:
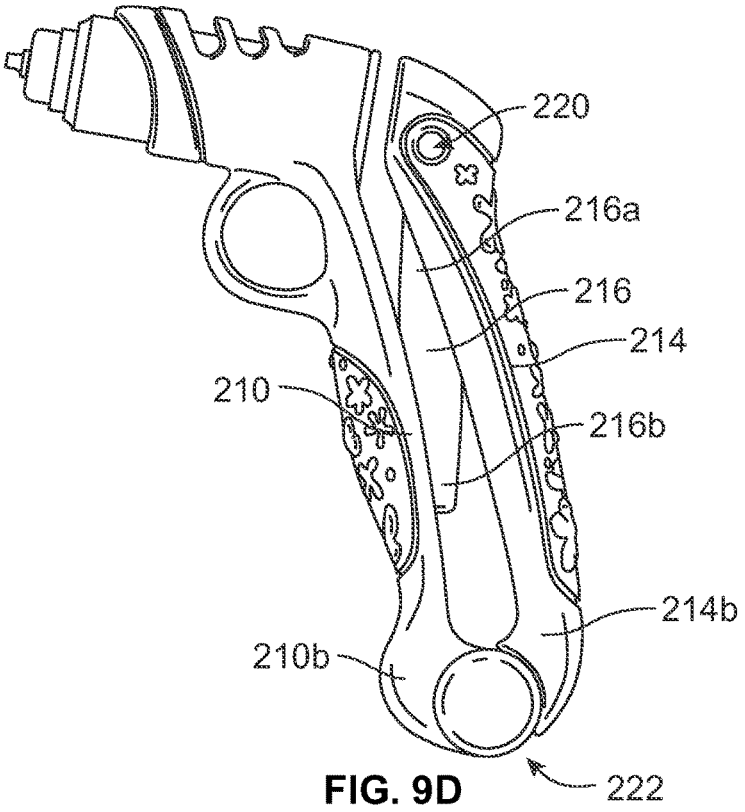
FIG. 9D illustrates the plunger handle pivoted to a second storage position resting the plunger rod intermediate the plunger handle and housing handle.

The plunger handle 214 supports the plunger rod 216, as seen in FIG. 9A, and the plunger handle has a first end 214*a* and a second end 214*b*, with the plunger rod secured to the plunger handle at the first end 214*a*. The plunger handle 214 and supported plunger rod 16 are also molded from the same heavy duty plastic material as the housing assembly. Additionally, a raised gripping area 215 is included along a length of the plunger handle for assisting the user in gripping the craft gun while extruding the moldable compound, as seen in FIG. 9B.

Figure 12:
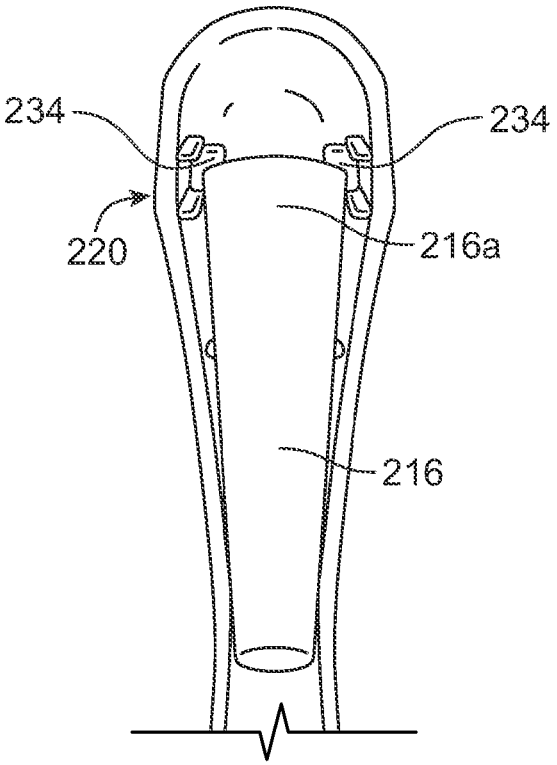
FIG. 12 illustrates a first coupling securing the plunger rod to a first end of the plunger handle and pivoting the plunger rod between the first extended position and the second folded position.
Figure 13:
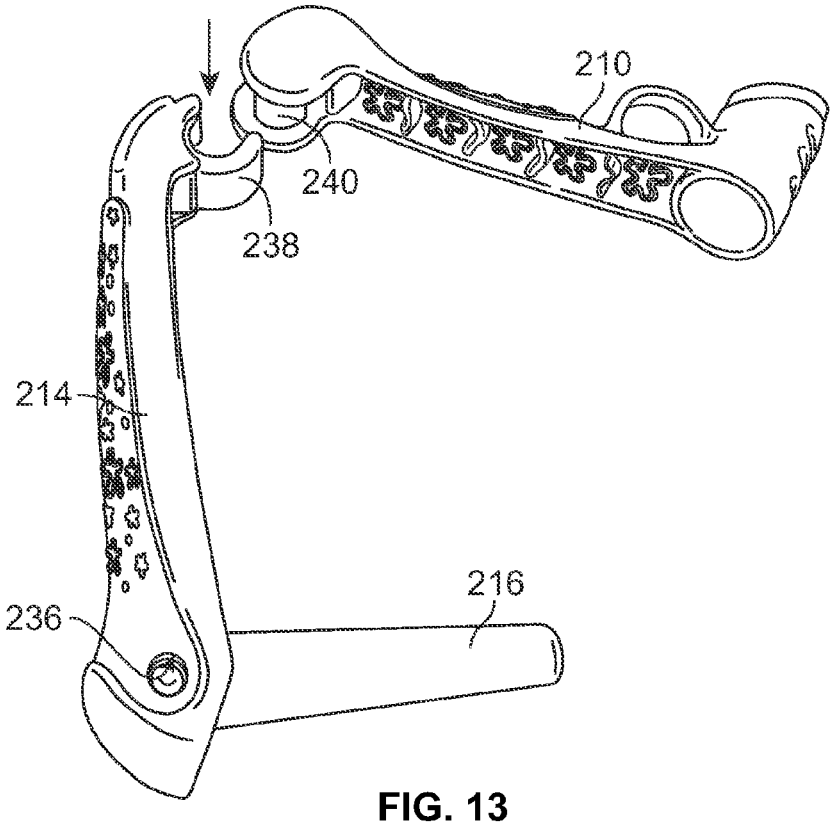
FIG. 13 illustrates a second coupling mechanically connecting a second end of the plunger handle to a second end of the housing handle pivoting the plunger handle between the first extruding position and the second storage position.

In the present described embodiment, the plunger rod 216 is generally tubular in shape and hollow inside with a first end 216*a* and a second end 216*b*. The plunger rod has a cross sectional thickness that tapers from the first end to the second end, with a thicker cross section at the first end 216*a* than the cross sectional thickness of the second end 216*b*, as seen in FIG. 9A and FIG. 12, for efficient extruding of the moldable material. Alternatively, the plunger rod can include a solid inside and have a consistent cross sectional thickness throughout the length of the rod.

A second storage cavity 232 extends along a length of the plunger handle 214 between the first end and the second end of the plunger handle, as seen in FIG. 11A. The second storage cavity 232 extends between the first end 214*a* and the second end 214*b* of the plunger handle and, in the present described embodiment, the second storage cavity 232 is integral with and molded within the plunger handle and manufactured from the same heavy duty plastic material. Alternatively, an elongated area along a length of the plunger handle 214 between the first end 214*a* and the second end 214*b* can be carved out and removed to form the second storage cavity 232. Additionally, the second storage cavity 232 is sized and shaped to partially contain the plunger rod 216 when the plunger rod is in the folded position, as seen in FIGS. 9C and 9D.

A first coupling 220 secures the plunger rod 216 to the first end of the plunger handle 214 for pivoting the plunger rod between a first extended position, as seen in FIG. 9A, and a second folded position, as seen in FIGS. 9C and 9D. In the first extended position, the plunger rod is aligned with the receptacle and ready for extruding, as seen in FIG. 9A, and in the second folded position the plunger rod is pivoted to contact the second storage cavity, as seen in FIG. 9C, and rest intermediate the plunger handle and the housing handle, as seen in FIG. 9D. Additionally, the plunger rod in the folded position is partially contained within both first and second storage cavities keeping the plunger handle spaced apart from the housing handle, as seen in FIG. 9D.

In the present described embodiment, the first coupling 220 includes two pins 234 secured to the plunger and inserted into two apertures 236 at the first end 214*a* of the plunger handle, as seen in FIGS. 11B and 12. A pin 234 is disposed on each side of the plunger rod at the first end 216*a*, opposite each other, and inserted into an aperture 236 disposed on either side of the plunger handle, opposite each other, as seen in FIG. 12. Each aperture 236 captures a pin 234, as seen in FIGS. 11B and 12, and maintains a secure yet pivoting connection between the plunger rod and the plunger handle. The diameter of each aperture is only slightly larger than the cross sectional thickness of each pin providing for a tight fit between each pin and aperture, allowing the plunger handle to reliably pivot at the first coupling 220 between a first extended position, as seen in FIG. 11A, and a second folded position, as seen in FIG. 11B.

A second coupling 222 mechanically connects the second end 214*b* of the plunger handle 214 to the second end 210*b* of the housing handle 210 for pivoting the plunger handle between a first extruding position, as seen in FIG. 9B, and a second storage position, as seen in FIG. 9D. In the first extruding position, as seen in FIG. 9B, the plunger rod, in the extended position, is aligned with the receptacle for extruding the modeling compound, and in the second storage position, as seen in FIG. 9D, the plunger handle is pivoted to a position adjacent the housing handle for storing the plunger rod in the folded position and partially within first and second storage cavities for easy transport of the craft gun.

In the present described embodiment, the second coupling 222 includes a curved C-shaped element 238 affixed to the second end of the plunger handle 214 linking with and pivoting on a rod element 240 affixed to the second end of the housing handle. The C-shaped element 238 is integral with the plunger handle and manufactured from the same heavy duty plastic material, and the rod element 240 is integral with the housing handle and also manufactured from the same heavy duty plastic material. The C-shaped element snaps onto the rod element forming a secure yet pivoting connection between the plunger handle and the housing handle. The C-shaped element can also include a semicircular ridge along an inside circumference which mates with and rides along a semicircular groove cut into an outside surface of the rod element, further providing a secure yet pivotable connection between the plunger handle and the housing handle.

In use, as seen in FIGS. 9A-9D, the plunger rod is pivoted to an extended position aligned with the receptacle, as seen in FIG. 9A, and the plunger handle is pivoted to the extruding position pivoting the plunger handle toward the housing handle with the plunger rod traversing the receptacle to extrude the modeling compound, as seen in FIG. 9B. After the user has extruded a desired amount of modeling compound, or if the user wishes to fill or refill modeling compound, the plunger handle is pivoted away from the housing handle and the plunger rod is pivoted away from alignment with the receptacle as seen in FIG. 9C. When the user desires to store the craft gun, the plunger handle is further pivoted away from the housing handle and the plunger rod is pivoted to the folded position, as seen in FIG. 9C. The plunger handle is then pivoted to the storage position located adjacent the housing handle for resting the plunger rod intermediate the plunger handle and housing handle and storing the plunger rod partially within both the first and second storage cavities for easy and convenient storage and transport of the craft gun, as seen in FIG. 9D.

In the present described embodiment, one or more of the first and second storage cavities, 230 and 232 respectively, includes an inner surface and further includes one or more ridge elements 233 affixed to the inner surface for abutting against the plunger rod in the folded position, keeping the plunger rod spaced apart from the inner surface, and the plunger handle spaced apart from the housing handle when the plunger handle is in the storage position, as seen in FIG. 9D. The ridge elements 233 can be slightly wavy as they traverse along the cross sectional width of the first and second storage cavities.

The ridge elements 233 prevent the first and second storage cavities from capturing the entire plunger rod within one or both of the first and second storage cavities. The ridge elements 233 also prevent the plunger handle from contacting the housing handle when the plunger rod is in the folded position and the plunger handle is in the storage position, as seen in FIG. 9D. Keeping a spaced apart distance between the plunger handle and housing handle during storage of the craft gun provides an anti-pinching mechanism that helps prevent the child user from pinching their fingers between the two handles of the folded craft gun, especially if the child puts the folded craft gun into their pocket for easy carrying.

In the present described embodiment, an inner surface 230*a* of the first storage cavity 230 includes two or more ridge elements 233 affixed to the inner surface, as seen in FIG. 10. The ridge elements 233 are integral with and molded within the first storage cavity and manufactured from the same heavy duty plastic material. As the plunger handle is pivoted to the storage position, the folded plunger rod abuts up against the ridge elements 233 to only partially contain the plunger rod in the first storage cavity, as seen in FIG. 9D.

Additionally, two or more ridge elements disposed at the inside surface of the first storage cavity rise to different heights from the inner surface of the first storage cavity providing for differing degrees of containment of the folded plunger rod into the first storage cavity at the differing heights of the ridge elements. A short ridge element 235, rising to a lesser height than the ridge elements 233 from the inner surface 230*a* of the first storage cavity, is further included at the inner surface 230*a* of the first storage cavity for allowing the second end 216*b* of the plunger rod to partially fold into the first storage cavity to a greater degree than the first end 216*a* of the plunger rod which abuts up against the taller ridge elements 233. The shorter ridge element 235 is integral with and molded within the first storage cavity and manufactured from the same heavy duty plastic material.

In a present described embodiment, an inner surface 232*a* of the second storage cavity 232 includes two or more ridge elements 233 affixed to the inner surface, as seen in FIG. 11A-11B. The ridge elements 233 are integral with and molded within the second storage cavity and manufactured from the same heavy duty plastic material. As the plunger rod is pivoted to the folded position, as seen in FIG. 11B, the plunger rod abuts up against the ridge elements 233 to only partially contain the plunger rod in the second storage cavity.

Additionally, two or more ridge elements disposed at the inside surface of the second storage cavity rise to different heights from the inner surface of the second storage cavity providing for differing degrees of containment of the folded plunger rod into the second storage cavity at the differing heights of the ridge elements. A short ridge element 235, rising to a lesser height than the ridge elements 233 from the inner surface 232*a* of the second storage cavity allows the first end 216*a* of the plunger rod to partially fold enter into the second storage cavity while preventing the second end 216*b* of the plunger rod, which abuts up against the taller ridge elements 233, from entering the second storage cavity, as seen in FIG. 11B. The shorter ridge element 235 is integral with and molded within the second storage cavity and manufactured from the same heavy duty plastic material.

In the present described embodiment, at least one removable cartridge 240 is received into the receptacle 224 of the housing 212 for containing the volume of modeling compound 218, as seen in FIGS. 9A-9D & 14-15. The cartridge 240 includes a cross section larger than a cross sectional thickness of the plunger rod 216, such that the plunger rod can traverse back and forth within the cartridge for extruding the contained modeling compound.

Figure 14:
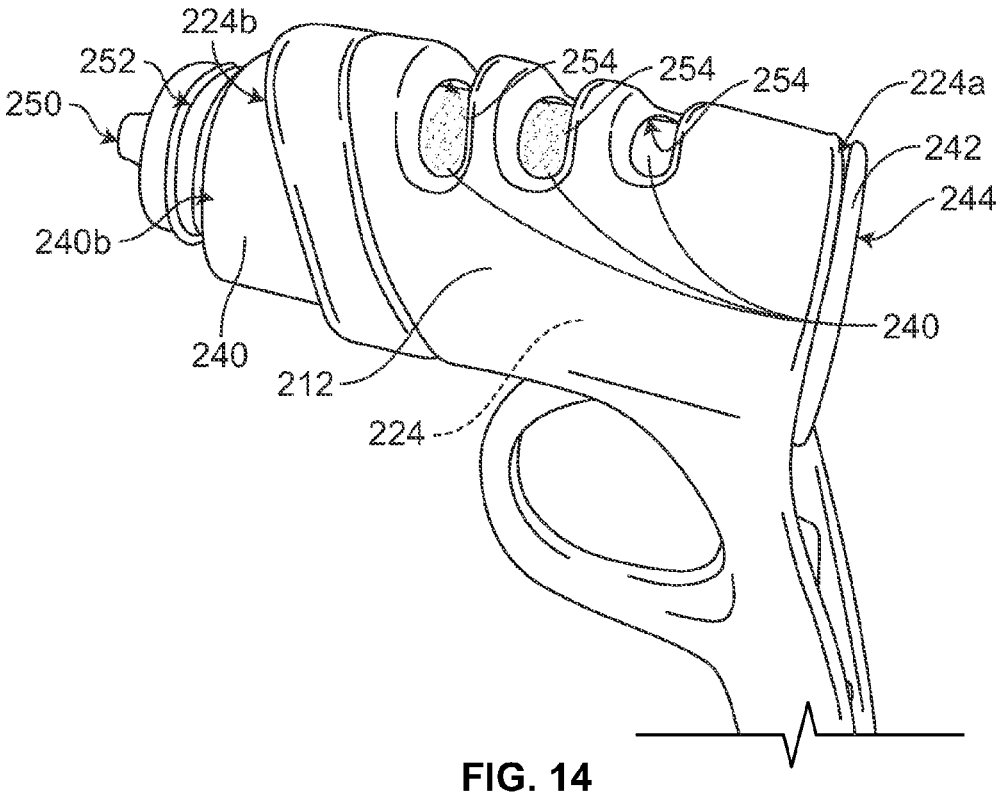
FIG. 14 illustrates one or more view holes in the housing assembly at the receptacle.
Figure 15A:
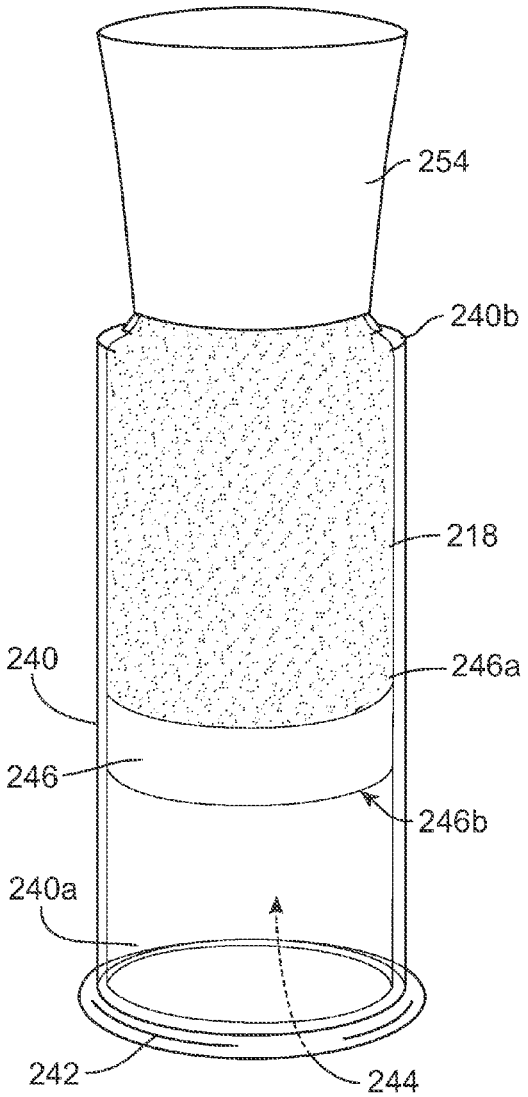

The cartridge 240 can include a variety of shapes and sizes capable of being received into the receptacle of the housing 212, and the cartridge can be manufactured from a variety of materials such as plastic, etc. and even clear materials such as a clear plastic, so that the child user may view colored modeling compounds contained in and extruded from the cartridge. The cartridge also includes a first end 240*a* and a second end 240*b*, as seen in FIG. 15A, and further includes a flange 242 at the first end 240*a* defining an opening or inlet 244. The cartridge 240 is received into the receptacle 224 such that the flange 242 abuts the first end 224*a* of the receptacle, as seen in FIG. 14. Cartridge 240 can be prefilled with modeling compound 218 prior to insertion of the cartridge into the receptacle 224, or alternatively, modeling compound can be filled into the cartridge while the cartridge is already in the receptacle because the plunger rod can be quickly and easily pivoted from alignment with the receptacle allowing the user access to the inserted cartridge for filling and/or refilling.

Figure 15B:
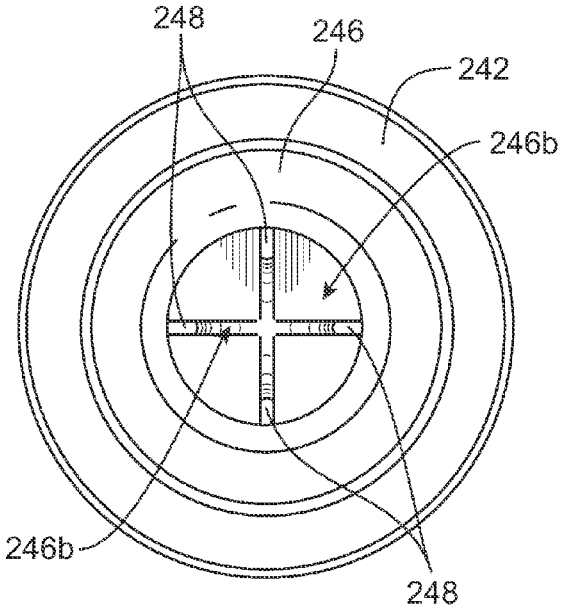
FIG. 15B illustrates an outside recessed surface of the cartridge plunger including two or more self-centering ridges.

The cartridge 240 further includes a cartridge plunger 246 disposed at, and plugging, the opening/inlet 244, as seen in FIG. 15A and enlarged view FIG. 15B. The cartridge plunger 246 seals the modeling compound into the cartridge for convenient storing of the compound in the cartridge and for creating a firm platform on which the plunger rod can apply a force for effective extruding of the compound from the cartridge.

The cartridge plunger 246 includes an inside surface 246*a* contacting the modeling compound 218 and an outside recessed surface 246*b* for capturing the plunger rod, as seen in FIGS. 15A-15B. Two or more self-centering ridges 248 are disposed at the outside recessed surface of the cartridge plunger, as seen in FIG. 15B, for centering the plunger rod on the cartridge plunger for easy and efficient extruding of the modeling compound.

Figure 16A:
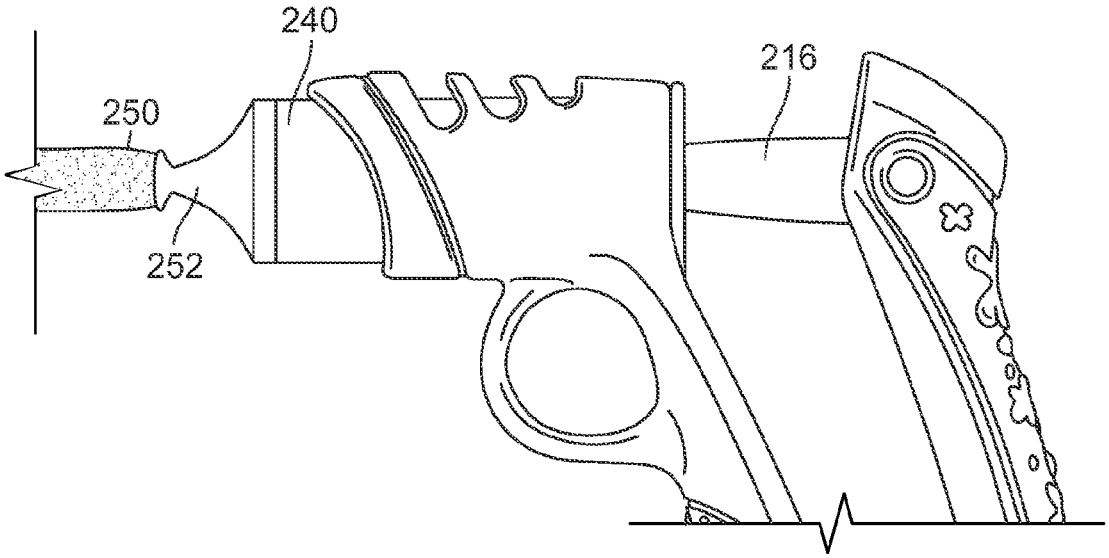
FIGS. 16A and 16B illustrate a second end of the cartridge including a narrowed outlet and two or more extrusion tips at the narrowed outlet having a variety of extrusion shapes.

Additionally, the cartridge 240 includes a narrowed outlet 250 at the second end 240*b*, and the second end further includes a threaded surface 252, as seen in FIG. 14. A threaded extrusion tip 252 is further screwed onto the threaded surface of the second end 240*b* for shaping the extruding modeling compound, as seen in FIG. 16A. A cap 254 is also included to seal off the outlet 250 of the cartridge for convenient storing of the compound within the cartridge 240, and easy transportation and sale of prefilled cartridges, as seen in FIG. 15A.

Two or more removable cartridges are further included, and in the present described embodiment, multiple cartridges can be prefilled with an assortment of colored modeling compounds and sold individually or together or even with a bigger craft or extrusion kit. Multiple prefilled cartridges provide a significant advantage to the user, especially the child user, who can avoid the need to clean cartridges between refilling with different colored modeling compounds, making it easier to change colors during use. In use, the prefilled removable cartridges 240 can be easily and quickly interchanged at the housing receptacle 224 enhancing the creative experience for a user who can extrude multiple varieties and/or colors of modeling compound quickly and easily during a single art project.

Figure 16B:
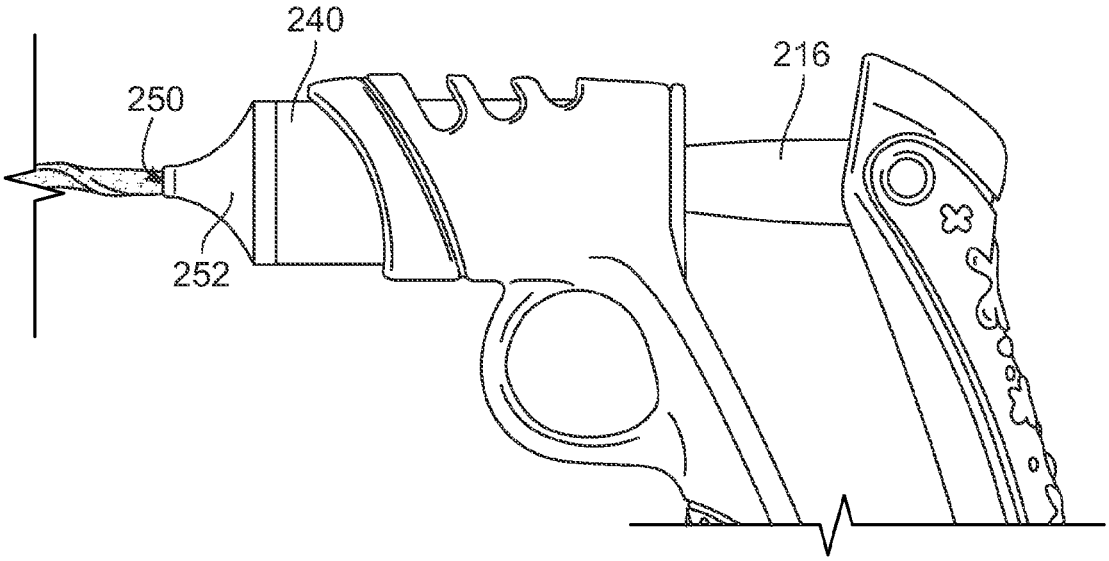

In the present described invention, two or more extrusion tips 252, having a variety of extruding shapes each interchangeable on the second end 240*b* of the cartridge 240 are further included, as seen in FIGS. 16A-16B. Each extrusion tip 252 can be screwed onto the threaded second end of the cartridge extruding particular shapes from the outlet 250 of the cartridge. Alternatively, an extrusion tip 252 can be integral with the cartridge, providing for a fixed extruding shape from each particular cartridge. The combination of multiple prefilled cartridges, including a variety of colored modeling compounds, with a number of interchangeable and replaceable extrusion tips for making different line patterns, provides numerous artistic opportunities for the user to easily produce creative works that are fun to make.

Additionally, in the present described embodiment, one or more view holes 254 are included in the housing assembly 212 at the receptacle and are aligned along a length of the receptacle 224 for viewing the volume of modeling compound 218 contained within the cartridge inserted into the receptacle, as seen in FIG. 14. Three view holes 254, of various sizes, are cut into and along a width of the housing assembly and are readily visible to the user act as a gage for observing the volume of modeling compound contained within the cartridge as the cartridge is contained within the receptacle of the housing. The user can readily observe the volume and color of modeling compound contained within the cartridge and not have to remove the cartridge, but instead simply look through the one or more view holes in the housing assembly to gage the volume and color of modeling compound in the cartridge. The child user especially, can delight in watching the modeling compound work its way toward the outlet of the cartridge as the modeling compound is simultaneously extruded from the outlet.

A method for folding a hand held craft gun upon itself for easy transport includes the steps of providing a housing assembly including a housing handle, the housing handle having a first end and a second end, defining a first storage cavity along a length of the housing handle between the first end and the second end of the housing handle, providing a plunger handle coupled to the housing handle and supporting a plunger rod, the plunger handle having a first end and a second end, and defining a second storage cavity along a length of the plunger handle between the first end and the second end of the plunger handle. Further providing a first coupling securing the plunger rod to the plunger handle for pivoting the plunger rod between a first extended position and a second folded position and pivoting the plunger rod to the second folded position containing the plunger rod partially within the second storage cavity provides for easy transport of the craft gun.

The method further includes providing the steps of providing a second coupling mechanically connecting the plunger handle to the housing handle for pivoting the plunger handle between a first extruding position and a second storage position, and pivoting the plunger handle to the second storage position disposing the plunger handle adjacent the housing handle partially containing the plunger rod within both the first and second storage cavities resting the plunger rod intermediate the plunger handle and the housing handle for folding the craft gun upon itself for easy transport. Additionally, the one or more of the first and second storage cavities includes an inner surface and one or more ridge elements are affixed to the inner surface for abutting against the plunger rod in the folded position keeping the plunger rod spaced apart from the inner surface and the plunger handle spaced apart from the housing handle when the plunger handle is in the storage position.

From the foregoing, it can be seen that there has been provided a unique craft gun that is simple to use yet provides a large variety of extruding options for a user by employing a simple yet unique coupling for pivoting a plunger rod between an unaligned position for fun and quick filling of a modeling compound and an aligned position for easy extruding, and employing simple yet unique storage cavities at a plunger handle and/or a housing handle for storing a plunger rod pivoted to a folded position and resting intermediate the plunger handle and housing handle for quick and easy transport of the folded craft gun. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A portable craft gun for extruding modeling compound and folding for easy transport, comprising:

a housing assembly;

a receptacle defined within the housing assembly;

a housing handle on the housing assembly and extending from the receptacle, the housing handle having a first end and a second end;

a first storage cavity extending along a length of the housing handle between the first end and the second end of the housing handle;

a plunger rod;

a plunger handle for supporting the plunger rod, the plunger handle having a first end and a second end;

a second storage cavity extending along a length of the plunger handle between the first end and the second end of the plunger handle; and a first coupling securing the plunger rod to the first end of the plunger handle for pivoting the plunger rod between a first extended position aligning the plunger rod with the receptacle and a second folded position resting the plunger rod intermediate the plunger handle and the housing handle, the plunger rod in the second folded position is partially contained within both first and second storage cavities keeping the plunger handle spaced apart from the housing handle.

2. The craft gun according to claim 1, further comprising a second coupling mechanically connecting the second end of the plunger handle to the second end of housing handle for pivoting the plunger handle between a first extruding position aligning the plunger rod in the extended position within the receptacle for extruding a modeling compound, and to a second storage position pivoting the plunger handle to a position adjacent the housing handle for storing the plunger rod in the folded position and partially within first and second storage cavities for easy transport.

3. The craft gun according to claim 1, wherein one or more of the first and second storage cavities includes an inner surface and further comprises one or more ridge elements affixed to the inner surface for abutting against the plunger rod in the folded position keeping the plunger rod spaced apart from the inner surface and the plunger handle spaced apart from the housing handle when the plunger handle is in the storage position.

4. The craft gun according to claim 3, wherein the inner surface of the first storage cavity further comprises two or more ridge elements affixed to the inner surface, the two or more ridge elements rising to different heights from the inner surface of the first storage cavity.

5. The craft gun according to claim 4, wherein the inner surface of the second storage cavity further comprises two or more ridge elements affixed to the inner surface, the two or more ridge elements rising to different heights from the inner surface of the second storage cavity.

6. The craft gun according to claim 1, wherein the second coupling further comprises a curved C-shaped element affixed to the second end of the plunger handle linking with and pivoting on a rod element affixed to the second end of the housing handle.

7. The craft gun according to claim 6, further comprising at least one removable cartridge received into the receptacle of the housing for containing a volume of modeling compound, the cartridge including a cross section larger than a cross sectional thickness of the plunger rod, and wherein the cartridge includes a first end and a second end, and further includes a flange at the first end defining an opening and a cartridge plunger disposed at, and plugging, the opening, the second end further includes a narrowed outlet.

8. The craft gun according to claim 7, wherein the cartridge plunger includes an inside surface contacting the modeling compound and an outside recessed surfaced for capturing the plunger rod, and further comprising two or more self-centering ridges at the outside recessed surface of the cartridge plunger for centering the plunger rod on the cartridge plunger for easy and efficient extruding of the modeling compound.

9. The craft gun according to claim 7, further comprising two or more extrusion tips having a variety of extruding shapes each interchangeable on the second end of the cartridge.

10. The craft gun according to claim 7, further comprising one or more view holes in the housing assembly at the receptacle, the one or more view holes are aligned along a length of the receptacle for viewing the volume of modeling compound contained within the cartridge inserted into the receptacle.

11. A portable craft gun for extruding modeling compound and folding for easy transport, comprising:

a housing assembly;

a receptacle defined within the housing assembly;

a housing handle on the housing assembly and extending from the receptacle, the housing handle having a first end and a second end;

a plunger rod;

a plunger handle for supporting the plunger rod, the plunger handle having a first end and a second end; and a first coupling securing the plunger rod to the first end of the plunger handle for pivoting the plunger rod between a first extended position aligning the plunger rod with the receptacle and a second folded position resting the plunger rod intermediate the plunger handle and the housing handle keeping the plunger handle spaced a distance apart from the housing handle, comprising a first storage cavity and a second storage cavity where the plunger rod in the second folded position is partially contained within both first and second storage cavities, and comprising a second coupling mechanically connecting the second end of the plunger handle to the second end of housing handle.

12. The craft gun according to claim 11, further comprising at least one removable cartridge received into the receptacle of the housing for containing the volume of modeling compound, the cartridge including a flange at the first end defining an opening and a cartridge plunger disposed therein.

13. A portable craft gun for extruding modeling compound and folding for easy transport, comprising:

a housing assembly;

a receptacle defined within the housing assembly;

a housing handle on the housing assembly and extending from the receptacle, the housing handle having a first end and a second end;

a plunger rod;

a plunger handle for supporting the plunger rod, the plunger handle having a first end and a second end;

a first coupling securing the plunger rod to the first end of the plunger handle for pivoting the plunger rod between a first extended position aligning the plunger rod with the receptacle and a second folded position resting the plunger rod intermediate the plunger handle and the housing handle;

a second coupling mechanically connecting the second end of the plunger handle to the second end of housing handle; and a first storage cavity and a second storage cavity where the plunger rod in the second folded position is partially contained within both first and second storage cavities intermediate the plunger handle and the housing handle.

14. The craft gun according to claim 13, wherein the unaligned plunger rod rests intermediate the plunger handle and the housing handle.

15. The craft gun according to claim 14, further comprising a second coupling mechanically connecting the second end of the plunger handle to the second end of housing handle for pivoting the plunger handle between a first extruding position aligning the plunger rod in the extended position within the receptacle for extruding a modeling compound, and to a second storage position pivoting the plunger handle to a position adjacent the housing handle for storing the plunger rod in the folded position and partially within first and second storage cavities for easy transport.

16. The craft gun according to claim 15, wherein the cartridge plunger includes an inside surface contacting the modeling compound and an outside recessed surfaced for capturing the plunger rod, and further comprising two or more self-centering ridges at the outside recessed surface of the cartridge plunger for centering the plunger rod on the cartridge plunger for easy and efficient extruding of the modeling compound.

17. The craft gun according to claim 13, further comprising at least one removable cartridge received into the receptacle of the housing for containing the volume of modeling compound, the cartridge including a cross section larger than a cross sectional thickness of the plunger rod and having a cartridge plunger disposed in a first end opening of the cartridge and the cartridge having a flange of the first end opening at the housing receptacle.

18. The craft gun according to claim 17, further comprising one or more view holes in the housing assembly at the receptacle, the one or more view holes are aligned along a length of the receptacle for viewing the volume of modeling compound contained within the cartridge inserted into the receptacle.

19. The craft gun according to claim 17, wherein the cartridge further includes a second end further comprising a narrowed outlet.

20. The craft gun according to claim 19, further comprising two or more extrusion tips having a variety of extruding shapes each interchangeable on the second end of the cartridge.

* * * * *